US009566797B2

(12) United States Patent
Nishiyama et al.

(10) Patent No.: US 9,566,797 B2
(45) Date of Patent: Feb. 14, 2017

(54) INKJET PRINTER

(71) Applicant: RISO KAGAKU CORPORATION, Tokyo (JP)

(72) Inventors: Akira Nishiyama, Ibaraki (JP); Naoto Tsujino, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/091,084

(22) Filed: Apr. 5, 2016

(65) Prior Publication Data

US 2016/0339713 A1 Nov. 24, 2016

(30) Foreign Application Priority Data

May 22, 2015 (JP) ..... 2015-104251
Mar. 22, 2016 (JP) ..... 2016-056804

(51) Int. Cl.
*B41J 2/15* (2006.01)
*B41J 2/18* (2006.01)

(52) U.S. Cl.
CPC ..... *B41J 2/18* (2013.01)

(58) Field of Classification Search
CPC ..... B41J 2/18; B41J 2/17513; B41J 2/175; B41J 2/1752; B41J 2/17566; B41J 2/17596
See application file for complete search history.

(56) References Cited

U.S. PATENT DOCUMENTS 8,231,212 B2 * 7/2012 Uptergrove ..... B41J 2/175 347/7
8,641,179 B2 * 2/2014 Kuribayashi ..... B41J 2/175 347/19
9,004,655 B2 * 4/2015 Tamaki ..... B41J 2/1752 347/108
2010/0073444 A1 3/2010 Sato

FOREIGN PATENT DOCUMENTS

JP 2010-076206 4/2010

* cited by examiner

*Primary Examiner* — Lamson Nguyen
(74) *Attorney, Agent, or Firm* — Hamre, Schumann, Mueller & Larson, P.C.

(57) ABSTRACT

An inkjet printer inkjet printer includes an inkjet head having a nozzle surface, a first tank for storing ink to be supplied to the inkjet head, a second tank for receiving ink that is not consumed by the inkjet head, an ink circulation path, a third tank directly or indirectly connected with a path from the second tank to the first tank on the ink circulation path, and a hermetic sealer for making the first and second tanks in a hermetically-sealed state. In a waiting mode in which ink is not circulated, the first and second tank is made in the hermetically-sealed state by the hermetic sealer and the third tank is made in an atmospherically-released state.

7 Claims, 10 Drawing Sheets

INKJET PRINTER

BACKGROUND OF THE INVENTION

Technical Field

The present invention relates to an ink-circulation type inkjet printer.

Background Arts

An ink-circulation type inkjet printer is known. In an ink-circulation type inkjet printer, printing is done by ejecting ink from an inkjet head(s) while circulating ink between a tank disposed on an upstream side of the inkjet head and another tank disposed on a downstream side of the inkjet head.

A patent Document 1 (Japanese Patent Application Publication No. 2010-76206) discloses an ink-circulation type inkjet printer in which tanks on upstream and downstream sides of an inkjet head(s) are disposed above a nozzle surface of an inkjet head.

In the ink-circulation type inkjet printer disclosed in the Patent Document 1, the tanks on upstream and downstream sides are needed to be in a hermetically-sealed state during a waiting mode in which ink is not circulated in order to prevent ink from flowing from the tanks to the inkjet head and then leaking through the nozzles.

SUMMARY OF THE INVENTION

However, in the waiting mode in which the tanks on upstream and downstream sides are in a hermetically-sealed state, it is concerned that menisci of ink in the nozzles are broken due to an environment change and thereby ink-leaking from the nozzles and air-suctioning through the nozzles may occur.

For example, in a case of moving an inkjet printer in a waiting mode from low altitude to high altitude, nozzle pressure with respect to atmospheric pressure increases due to reduction of atmospheric pressure. As the result, menisci are broken and thereby ink-leaking from the nozzles may occur. On the other hand, in a case of moving an inkjet printer in a waiting mode from high altitude to low altitude, nozzle pressure with respect to atmospheric pressure decreases due to elevation of atmospheric pressure. As the result, menisci are broken and thereby air-suctioning through the nozzles may occur.

An object of the present invention is to provide an inkjet printer that can prevent ink-leaking from nozzles and air-suctioning through nozzles in its waiting mode.

An aspect of the present invention provides an inkjet printer comprising: an inkjet head that has a nozzle surface on which nozzles for ejecting ink are opened; a first tank that stores ink to be supplied to the inkjet head; a second tank that receives ink that is not consumed by the inkjet head; an ink circulation path through which ink is circulated among the inkjet head, the first tank and the second tank; a third tank that is directly or indirectly connected with a path from the second tank to the first tank on the ink circulation path, and stores ink; and a hermetic sealer that makes the first tank and the second tank in a hermetically-sealed state that is hermetically sealed from atmosphere, wherein the first tank and the second tank are made in the hermetically-sealed state by the hermetic sealer in a waiting mode in which ink is not circulated, and the third tank is made in an atmospherically-released state in the waiting mode.

According to the aspect, a nozzle pressure in the waiting mode is determined according to a height level difference between a liquid level in the third tank that is atmospherically released and the nozzle surface. Therefore, even if atmospheric pressure changes due to an environment change, the nozzle pressure is restricted from changing and thereby ink-leaking from the nozzles and air-suctioning through the nozzles can be restricted.

It is preferable that the inkjet printer further comprises a changer that changes over the third tank between the hermetically-sealed state and the atmospherically-released state, wherein the third tank is disposed on the path from the second tank to the first tank, the third tank is made into the hermetically-sealed state by the changer and negative pressure that is used for sending ink from the second tank to the third tank is generated in the third tank in the waiting mode, and the third tank is made into the atmospherically-released state by the changer in the waiting mode.

According to this, negative pressure is generated in the third tank in the ink circulating mode. The third tank is made into the atmospherically-released state in the waiting mode. Therefore, with the configuration of disposing the third tank on the ink circulation path, it becomes possible to supply ink from the first tank to the second tank in the ink circulating mode by use of the negative pressure in the third tank and to determine a nozzle pressure in the waiting mode according to a height level difference between a liquid level in the third tank and the nozzle surface.

It is preferable that the third tank is indirectly connected with the path from the second tank to the first tank by interposing a connecting path that is connected with the path from the second tank to the first tank.

According to this, with the configuration of disposing the third tank outside the ink circulation path, a nozzle pressure in the waiting mode can be determined according to a height level difference between a liquid level in the third tank and the nozzle surface.

It is preferable that the third tank is disposed on the path from the second tank to the first tank, and made into an atmospherically-released state in an ink circulation mode and the waiting mode, a pump that sends ink from the second tank to the third tank is disposed on a path from the second tank to the third tank, a diversion path that diverts the pump is provided, a diversion switch that is switched over between an opened state for opening the diversion path and a closed state for closing the diversion path is provided, the diversion switch is made into the closed state and ink is sent from the second tank to the third tank by the pump in the ink circulating mode, and the diversion switch is made into the opened state in the waiting mode.

According to this, with the configuration of disposing the third tank on the ink circulation path, decrease of flow volume due to pressure loss in the path from the second tank to the third tank can be restricted, and a nozzle pressure in the waiting mode can be determined according to a height level difference between a liquid level in the third tank and the nozzle surface.

It is preferable that the third tank is disposed below the nozzle surface.

According to this, a nozzle pressure in the waiting mode can be set as negative pressure. Therefore, ink-leaking in the waiting mode can be restricted more effectively.

It is preferable that the first tank and the second tank is connected with each other while interposing a valve that is opened when being de-energized therebetween, and, when the valve is opened in the ink circulating mode in a state where positive pressure is generated in the first tank and negative pressure is generated in the second tank, the positive pressure in the first tank and the negative pressure in the second tank are offset with each other.

According to this, even if power shutdown occurs in the ink circulating mode, pressures in the first tank and the second tank can be relieved by opening of the valve.

It is preferable that each of the inkjet head, the first tank, the second tank and the ink circulation path is provided in a plurality with respect to the third tank.

According to this, it become possible to establish a configuration provided with the plural inkjet heads for a single ink color without a complicating configuration of the inkjet printer.

DESCRIPTION OF THE EMBODIMENT

Figure 1:
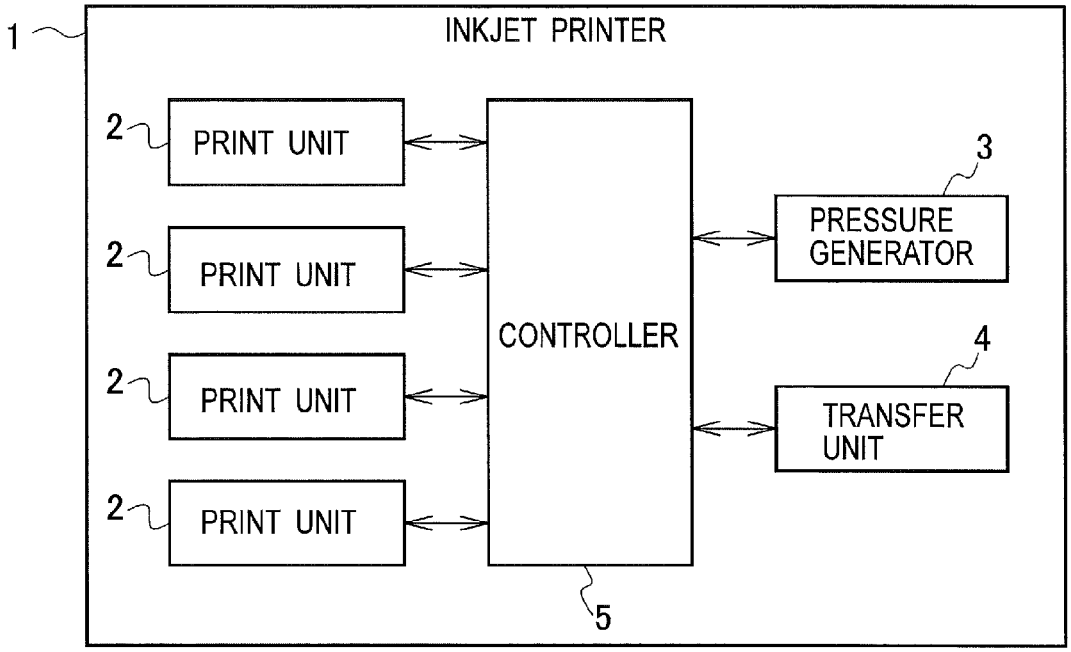
FIG. 1 is a block diagram of an inkjet printer according to a first embodiment.

Hereinafter, embodiments will be described with reference to the drawings. In the drawings, identical or equivalent components to each other are indicated by an identical reference number.

Note that the embodiments described below disclose components schematically, and it should be understood that the components in the drawings may not be shown precisely as they are. In addition, actual dimensions of the components and actual dimensional proportions among the components may be shown differently in the drawings.

First Embodiment

As shown in FIG. 1, an inkjet printer 1 according to a first embodiment includes four print units 2, a pressure generator 3, a transfer unit 4, and a controller 5.

Each of the print units 2 prints images on a paper being transferred by the transfer unit 4 by ejecting ink onto the paper while circulating ink. The four print units 2 eject different color inks (e.g. black, cyan, magenta, and yellow), respectively. Other than colors of inks to be ejected, the four print units 2 have an identical configuration to each other.

Figure 2:
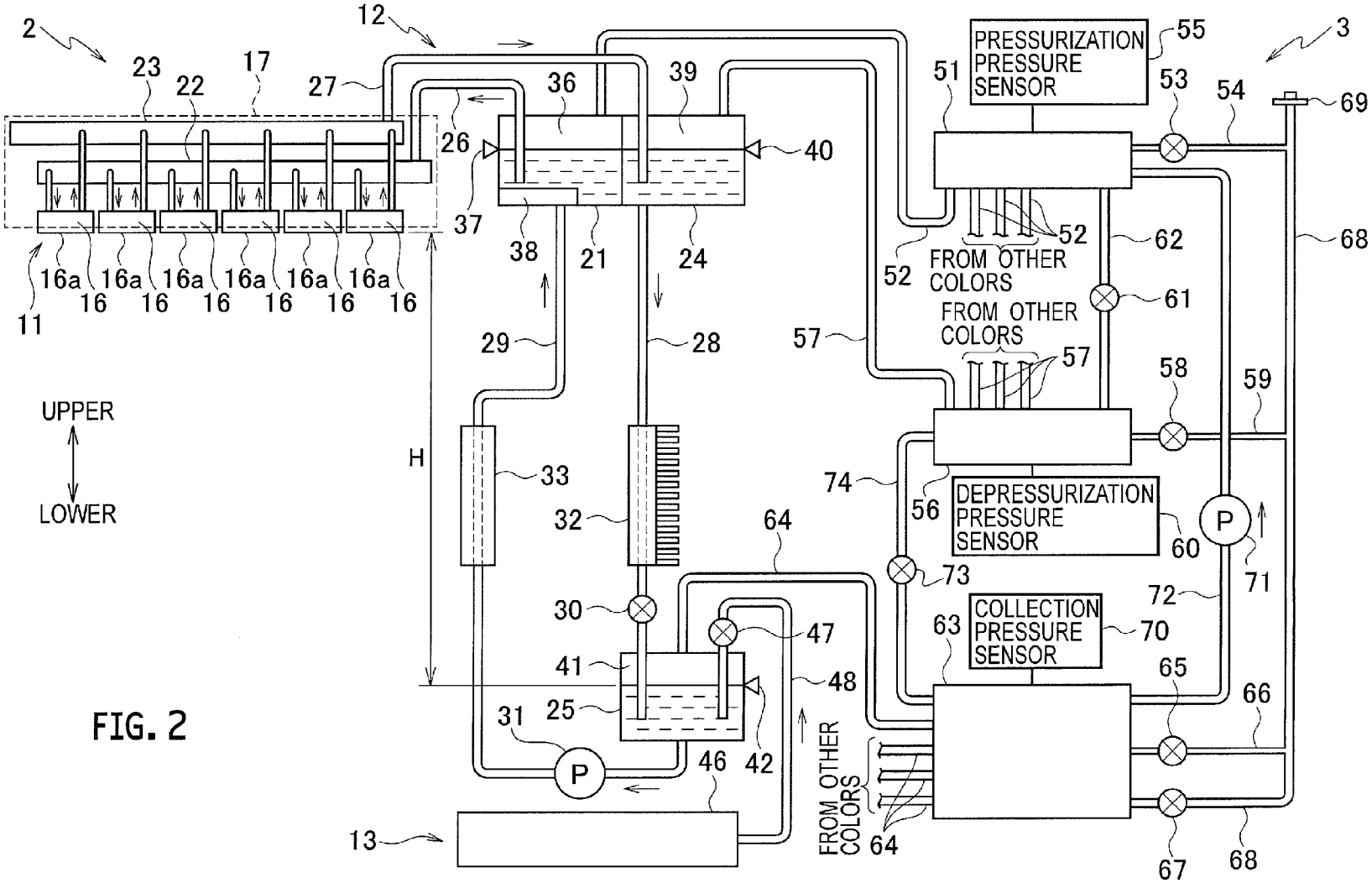
FIG. 2 is a schematic configuration diagram of a print unit and a pressure generator of the inkjet printer.

As shown in FIG. 2, each of the print units 2 includes an inkjet head 11, an ink circulator 12, and an ink reservoir 13.

The inkjet head 11 ejects ink supplied by the ink circulator 12. The inkjet head 11 has plural head modules 16.

Each of the head modules 16 has an ink chamber (not shown) for storing ink, plural nozzles (not shown) for ejecting ink, and nozzle surfaces 16*a* on which nozzles are opened. A piezoelectric element (not shown) is disposed in the ink chamber. Ink is ejected from the nozzles by driving the piezoelectric element. The nozzle surfaces are bottom surfaces of the head modules 16 that face to a paper transferred by the transfer unit 14.

The head modules 16 are held by a head holder 17. The head holder 17 holds the head modules 16 of the inkjet head 11 of the print unit 2, and accommodates a distributor 22 and a collector 23 therein. The distributor 22 and the collector 23 will be described later.

The ink circulator 12 supplies ink to the inkjet head 11 while circulating the ink. The ink circulator 12 includes a pressurization tank (that corresponds to a first tank recited in claims) 21, the distributor 22, the collector 23, a depressurization tank (that corresponds to a second tank recited in claims) 24, a collection tank (that corresponds to a third tank recited in claims) 25, ink circulation pipes 26 to 29, an ink collection valve 30, an ink circulation pump 31, a heatsink 32, and a heater 33.

The pressurization tank 21 stores ink to be supplied to the inkjet head 11. The ink in the pressurization tank 21 is supplied to the inkjet head 11 via the ink circulation pipe 26 and the distributor 22. Namely, the pressurization tank 21 is disposed on an upstream side of the inkjet head 11 in an ink circulation direction. In the pressurization tank 21, an air space 36 is formed above a liquid surface of the ink. The pressurization tank 21 is connected with an after-described pressurization communal air chamber 51 via an after-described pressurization communicating pipe 52. The pressurization tank 21 is disposed near the inkjet head 11, and at a higher height level than (above) the nozzle surfaces 16*a*.

A pressurization tank liquid level sensor 37 and an ink filter 38 are provided in the pressurization tank 21.

The pressurization tank liquid level sensor 37 detects whether or not a liquid level of the ink in the pressurization tank 21 reaches a reference height level. The pressurization tank liquid level sensor 37 outputs an "ON" signal when the liquid level in the pressurization tank 21 stays at the reference height level or is higher than the reference height level, and outputs an "OFF" signal when the liquid level is lower than the reference height level.

The ink filter 38 removes dusts and so on in the ink.

The distributor 22 distributes the ink supplied from the pressurization tank 21 via the ink circulation pipe 26 to the head modules 16 of the inkjet head 11.

The collector 23 collects ink that is not consumed by the inkjet head 11 from the head modules 16. The ink collected by the collector 23 flows to the depressurization tank 24 via the ink circulation pipe 27.

The depressurization tank 24 receives the ink that is not consumed by the inkjet head 11 from the collector 23, and then stores it. Namely, the depressurization tank 24 is disposed on a downstream side of the inkjet head 11 in the ink circulation direction. In the depressurization tank 24, an air space 39 is formed above a liquid surface of the ink. The depressurization tank 24 is connected with an after-described depressurization communal air chamber 56 via an after-described depressurization communicating pipe 57. The depressurization tank 24 is disposed near the inkjet head 11 and the pressurization tank 21, and at the same height level as that of the pressurization tank 21.

A depressurization tank liquid level sensor 40 is provided in the depressurization tank 24. The depressurization tank liquid level sensor 40 detects whether or not a liquid level of the ink in the depressurization tank 24 reaches a reference height level. The depressurization tank liquid level sensor 40 outputs an "ON" signal when the liquid level in the depressurization tank 24 stays at the reference height level or is higher than the reference height level, and outputs an "OFF" signal when the liquid level is lower than the reference height level.

The collection tank 25 stores ink to be supplied to the pressurization tank 21. The collection tank 25 receives ink supplied from the ink reservoir 13, and then stores the supplied ink. In addition, the collection tank 25 receives ink from the depressurization tank 24, and then stores it. The collection tank 25 is connected with the pressurization tank 21 via the ink circulation pipe 29, and also connected with the depressurization tank 24 via the ink circulation pipe 28. Therefore, the collection tank 25 is disposed on a path from the depressurization tank 24 to the pressurization tank 21 on an ink circulation path. In other words, the collection tank 25 is directly connected with the path from the depressurization tank 24 to the pressurization tank 21 on the ink circulation path. In the collection tank 25, an air space 41 is formed above a liquid surface of the ink. The collection tank 25 is connected with an after-described collection communal air chamber 63 via an after-described collection communicating pipe 64. The collection tank 25 is disposed at a lower height level than (below) the nozzle surfaces 16*a* of the head modules 16 of the inkjet head 11.

A collection tank liquid level sensor 42 is provided in the collection tank 25. The collection tank liquid level sensor 42 detects whether or not a liquid level of the ink in the collection tank 25 reaches a reference height level. The collection tank liquid level sensor 42 outputs an "ON" signal when the liquid level in the collection tank 25 stays at the reference height level or is higher than the reference height level, and outputs an "OFF" signal when the liquid level is lower than the reference height level.

The ink circulation pipe 26 connects the pressurization tank 21 with the distributor 22. In the ink circulation pipe 26, ink flows from the pressurization tank 21 to the distributor 22. The ink circulation pipe 27 connects the collector 23 with the depressurization tank 24. In the ink circulation pipe 27, ink flows from the collector 23 to the depressurization tank 24. The ink circulation pipe 28 connects the depressurization tank 24 with the collection tank 25. In the ink circulation pipe 28, ink flows from the depressurization tank 24 to the collection tank 25. The ink circulation pipe 29 connects the collection tank 25 with the pressurization tank 21. In the ink circulation pipe 29, ink flows from the collection tank 25 to the pressurization tank 21. The ink circulation path among the pressurization tank 21, the inkjet head 11, the depressurization tank 24 and the collection tank 25 is comprised of the ink circulation pipes 26 to 29, the distributor 22 and the collector 23.

The ink collection valve 30 opens or closes an ink flow path in the ink circulation pipe 28. The ink collection valve 30 is provided on the middle of the ink circulation pipe 28. The ink collection valve 30 is a normal-open type electromagnetic valve, which is closed while it is energized and opened while it is de-energized.

The ink circulation pump 31 sends ink from the collection tank 25 to the pressurization tank 21. The ink circulation pump 31 is provided on the middle of the ink circulation pipe 29.

The heatsink 32 cools ink circulated in the ink circulator 12. The heatsink 32 is provided on the middle of the ink circulation pipe 28.

The heater 33 heats ink circulated in the ink circulator 12. The heater 33 is provided on the middle of the ink circulation pipe 29.

The ink reservoir 13 replenishes the ink circulator 12 with ink. The ink reservoir 13 includes an ink cartridge 46, an ink reservoir valve 47, and an ink reservoir pipe 48.

The ink cartridge 46 stores ink to be used by the inkjet head 11 for printing. The ink in the ink cartridge is supplied to the collection tank 25 of the ink circulator 12 via the ink reservoir pipe 48.

The ink reservoir valve 47 opens or closes an ink flow path in the ink reservoir pipe 48. The ink reservoir valve 47 is provided on the middle of the ink reservoir pipe 48. The ink reservoir valve 47 is a normal-open type electromagnetic valve.

The ink reservoir pipe 48 connects the ink cartridge 46 with the collection tank 25. When the ink reservoir valve 47 is opened during the ink circulation, ink flows through the ink reservoir pipe 48 from the ink cartridge 46 to the collection tank 25 due to a negative pressure generated in the collection tank 25.

The pressure generator 3 generates pressures used for circulating ink in the pressurization tank 21, the depressurization tank 24 and the collection tank 25 of each of the print units 2. As shown in FIG. 2, the pressure generator 3 includes a pressurization communal air chamber 51, four pressurization communicating pipes 52, a pressurization pressure regulation valve 53, a pressurization pressure regulation pipe 54, a pressurization pressure sensor 55, a depressurization communal air chamber 56, four depressurization communicating pipes 57, a depressurization pressure regulation valve 58, a depressurization pressure regulation pipe 59, a depressurization pressure sensor 60, a pressurization and depressurization communicating valve 61, a pressurization and depressurization communicating pipe 62, a collection communal air chamber 63, four collection communicating pipes 64, a collection pressure regulation valve 65, a collection pressure regulation pipe 66, a collection atmospheric release valve 67, a collection atmospheric release pipe 68, an air filter 69, a collection pressure sensor 70, an air pump 71, an air pump pipe 72, a depressurization valve 73, and a depressurization pipe 74.

The pressurization communal air chamber 51 is an air chamber for equalizing pressures in the pressurization tanks 21 of all the print units 2. The pressurization communal air chamber 51 is communicated with the air spaces 36 in the pressurization tanks 21 of the four print units 2 via the four pressurization communicating pipes 52, respectively. Therefore, the pressurization tanks 21 of all the print units 2 are communicated with each other via the pressurization communal air chamber 51 and the pressurization communicating pipes 52.

Each of the pressurization communicating pipes 52 communicates the pressurization communal air chamber 51 with the air space 36 in the pressurization tank 21. The four pressurization communicating pipes 52 are provided so that they are associated with the print units 2 one for one. One end of the pressurization communicating pipe(s) 52 is connected with the pressurization communal air chamber 51, and another end thereof is connected with the air space 36 in the pressurization tank 21.

The pressurization pressure regulation valve 53 opens or closes an air flow path in the pressurization pressure regulation pipe 54 in order to regulate pressures in the pressurization communal air chamber 51 and the pressurization tank 21. The pressurization pressure regulation valve 53 is provided on the middle of the pressurization pressure regulation pipe 54. The pressurization pressure regulation valve 53 is a normal-open type electromagnetic valve, which is closed when energized and opened when de-energized. Note that the pressurization pressure regulation valve 53 corresponds to part of a hermetic sealer recited in claims.

The pressurization pressure regulation pipe 54 forms the air flow path for regulating pressures in the pressurization communal air chamber 51 and the pressurization tank 21. One end of the pressurization pressure regulation pipe 54 is connected with the pressurization communal air chamber 51, and another end thereof is connected with the collection atmospheric release pipe 68.

The pressurization pressure sensor 55 detects pressure in the pressurization communal air chamber 51. The pressure in the pressurization communal air chamber 51 is equal to every pressure in the pressurization tanks 21 of the print units 2, because the pressurization communal air chamber 51 and the air spaces 36 in the pressurization tanks 21 are communicated with each other.

The depressurization communal air chamber 56 is an air chamber for equalizing pressures in the depressurization tanks 24 of all the print units 2. The depressurization communal air chamber 56 is communicated with the air spaces 39 in the depressurization tanks 24 of the four print units 2 via the four depressurization communicating pipes 57, respectively. Therefore, the depressurization tanks 24 of all the print units 2 are communicated with each other via the depressurization communal air chamber 56 and the depressurization communicating pipes 57.

Each of the depressurization communicating pipes 57 communicates the depressurization communal air chamber 56 with the air space 39 in the depressurization tank 24. The four depressurization communicating pipes 57 are provided so that they are associated with the print units 2 one for one. One end of the depressurization communicating pipe(s) 57 is connected with the depressurization communal air chamber 56, and another end thereof is connected with the air space 39 in the depressurization tank 24.

The depressurization pressure regulation valve 58 opens or closes an air flow path in the depressurization pressure regulation pipe 59 in order to regulate pressures in the depressurization communal air chamber 56 and the depressurization tank 24. The depressurization pressure regulation valve 58 is provided on the middle of the depressurization pressure regulation pipe 59. The depressurization pressure regulation valve 58 is a normal-open type electromagnetic valve. Note that the depressurization pressure regulation valve 58 corresponds to part of a hermetic sealer recited in claims.

The depressurization pressure regulation pipe 59 forms the air flow path for regulating pressures in the depressurization communal air chamber 56 and the depressurization tank 24. One end of the depressurization pressure regulation pipe 59 is connected with the depressurization communal air chamber 56, and another end thereof is connected with the collection atmospheric release pipe 68.

The depressurization pressure sensor 60 detects pressure in the depressurization communal air chamber 56. The pressure in the depressurization communal air chamber 56 is equal to every pressure in the depressurization tanks 24 of the print units 2, because the depressurization communal air chamber 56 and the air spaces 39 in the depressurization tanks 24 are communicated with each other.

The pressurization and depressurization communicating valve 61 opens or closes an air flow path in the pressurization and depressurization communicating pipe 62 in order to change over communication or non-communication between the pressurization communal air chamber 51 and the depressurization communal air chamber 56. The pressurization and depressurization communicating valve 61 is provided on the middle of the pressurization and depressurization communicating pipe 62. The pressurization and depressurization communicating valve 61 is a normal-open type electromagnetic valve. When the pressurization and depressurization communicating valve 61 is opened to communicate the pressurization communal air chamber 51 and the depressurization communal air chamber 56 with each other, the pressurization tank(s) 21 and the depressurization tank(s) 24 are communicated with each other via the pressurization communicating pipe(s) 52, the pressurization communal air chamber 51, the pressurization and depressurization communicating pipe 62, the depressurization communal air chamber 56, and the depressurization communicating pipe(s) 57. Namely, by opening or closing the pressurization and depressurization communicating valve 61, communication or non-communication between the pressurization tank(s) 21 and the depressurization tank(s) 24 is changed over. Therefore, the pressurization tank(s) 21 and the depressurization tank(s) 24 are connected with each other while interposing the pressurization and depressurization communicating valve 61 therebetween. The pressurization and depressurization communicating valve 61 corresponds to a valve recited in claims.

The pressurization and depressurization communicating pipe 62 forms an air flow path for communicating the pressurization communal air chamber 51 and the depressurization communal air chamber 56 with each other. One end of the pressurization and depressurization communicating pipe 62 is connected with the pressurization communal air chamber 51, and another end thereof is connected with the depressurization communal air chamber 56.

The collection communal air chamber 63 is an air chamber for equalizing pressures in the collection tanks 25 of all the print units 2. The collection communal air chamber 63 is communicated with the air spaces 41 in the collection tanks 25 of the four print units 2 via the four collection communicating pipes 64, respectively. Therefore, the collection tanks 25 of all the print units 2 are communicated with each other via the collection communal air chamber 63 and the collection communicating pipes 64.

Each of the collection communicating pipes 64 communicates the collection communal air chamber 63 with the air space 41 in the collection tank 25. The four collection communicating pipes 64 are provided so that they are associated with the print units 2 one for one. One end of the collection communicating pipe(s) 64 is connected with the collection communal air chamber 63, and another end thereof is connected with the air space 41 in the collection tank 25.

The collection pressure regulation valve 65 opens or closes an air flow path in the collection pressure regulation pipe 66 in order to regulate pressures in the collection communal air chamber 63 and the collection tank 25. The collection pressure regulation valve 65 is provided on the middle of the collection pressure regulation pipe 66. The collection pressure regulation valve 65 is a normal-open type electromagnetic valve.

The collection pressure regulation pipe 66 forms the air flow path for regulating pressures in the collection communal air chamber 63 and the collection tank 25. One end of the collection pressure regulation pipe 66 is connected with the collection communal air chamber 63, and another end thereof is connected with the collection atmospheric release pipe 68.

The collection atmospheric release valve 67 opens or closed an air flow path in the collection atmospheric release pipe 68 in order to change over the collection communal air chamber 63 and the collection tank 25 between a hermetically-sealed state (in a state of being hermetically sealed from atmosphere) and an atmospherically-released state (in a state of being atmospherically released). Note that the hermetically-sealed state may be also called as an air-tight state. The collection atmospheric release valve 67 is provided near the collection communal air chamber 63 on the collection atmospheric release pipe 68. The collection atmospheric release valve 67 is a normal-open type electromagnetic valve. Note that the collection atmospheric release valve 67 corresponds to a changer recited in claims The collection atmospheric release pipe 68 forms an air flow path for atmospherically purging the collection communal air chamber 63 and the collection tank 25. One end of the collection atmospheric release pipe 68 is connected with the collection communal air chamber 63, and another end (an upper end) thereof is opened to atmosphere via the air filter 69. The pressurization pressure regulation pipe 54, the depressurization pressure regulation pipe 59 and the collection pressure regulation pipe 66 are connected with the collection atmospheric release pipe 68. Therefore, pressurization pressure regulation pipe 54, the depressurization pressure regulation pipe 59 and the collection pressure regulation pipe 66 can be opened to atmosphere. The pressurization pressure regulation pipe 54, the depressurization pressure regulation pipe 59 and the collection pressure regulation pipe 66 are connected with the collection atmospheric release pipe 68 between the collection atmospheric release valve 67 and the air filter 69 on the collection atmospheric release pipe 68.

The air filter 69 prevents dusts and so on in air from entering into the collection atmospheric release pipe 68. The air filter 69 is disposed at the upper end of the collection atmospheric release pipe 68.

The collection pressure sensor 70 detects pressure in the collection communal air chamber 63. The pressure in the collection communal air chamber 63 is equal to every pressure in the collection tanks 25 of the print units 2, because the collection communal air chamber 63 and the air spaces 41 in the collection tanks 25 are communicated with each other.

The air pump 71 suctions air from the collection communal air chamber 63, and sends the air to the pressurization communal air chamber 51. The air pump 71 is provided on the middle of the air pump pipe 72.

The air pump pipe 72 forms an air flow path for sending air from the collection communal air chamber 63 to the pressurization communal air chamber 51 by the air pump 71. One end of the air pump pipe 72 is connected with the collection communal air chamber 63, and another thereof is connected with the pressurization communal air chamber 51.

The depressurization valve 73 opens or closes an air flow path in the depressurization pipe 74 in order to decrease pressure in the depressurization communal air chamber 56 by using pressure in the collection communal air chamber 63. The depressurization valve 73 is provided on the middle of the depressurization pipe 74. The depressurization valve 73 is a normal-open type electromagnetic valve. Note that the depressurization valve 73 corresponds to part of a hermetic sealer recited in claims.

The depressurization pipe 74 forms the air flow path for decreasing pressure in the depressurization communal air chamber 56 by using pressure in the collection communal air chamber 63. One end of the depressurization pipe 74 is connected with the collection communal air chamber 63, and another end thereof is connected with the depressurization communal air chamber 56.

Hereinafter, air volume design for a pressurization system and a depressurization system in the print units 2 and the pressure generator 3 will be described.

Although it will be described in detail later, the depressurization communicating valve 61 is opened when ink circulation is finished in the inkjet printer 1. An air volume of the pressurization system including the pressurization tanks 21 and the pressurization communal air chamber 51 and an air volume of the depressurization system including the depressurization tanks 24 and the depressurization communal air chamber 56 are designed so that positive pressure of the pressurization system in an ink circulating mode and negative pressure of the depressurization system in the ink circulating mode are offset with each other by the above-mentioned operation for opening the depressurization communicating valve 61 and thereby pressures in the pressurization tanks 21, the pressurization communal air chamber 51, the depressurization tanks 24 and the depressurization communal air chamber 56 become atmospheric pressure substantially.

Specifically, the air volume Vk1 of the pressurization system and the air volume Vf1 of the depressurization system in the inkjet printer 1 are designed so that a following equation (1) is satisfied by the Boyle's law. Note that pressures are gauge pressure.

$$Pks \times Vk1 + Pfs \times Vf1 = 0 \quad (1)$$

The "Pks" is a preset pressure of the pressurization tanks 21 in the ink circulating mode. The "Pfs" is a preset pressure of the depressurization tanks 24 in the ink circulating mode. The "Pks" and the "Pfs" are determined as pressure values for setting the nozzle pressure of the inkjet heads at a proper value (negative pressure) while circulating ink with a predetermined ink circulation amount in the ink circulator 12.

The air volume Vk1 of the pressurization system is an air volume that is associated with portions communicated with the pressurization tanks 21 in the ink circulating mode and generates the preset pressure Pks together with the pressurization tanks 21. The air volume Vk1 of the pressurization system is indicated by a following equation (2).

$$Vk1 = 4 \times Vkt + Vkc + 4 \times Vkr + Vkb + Vkn + Vkp \quad (2)$$

The "Vkt" is a capacity of the air space 36 in the pressurization tank 21. The "Vkt" corresponds to a volume of a space higher than the reference height level of the liquid level in the pressurization tank 21. The "Vkc" is a capacity of the pressurization communal air chamber 51. The "Vkr" is a capacity of the pressurization communicating pipe 52. The "Vkb" is a capacity of a portion of the pressurization pressure regulation pipe 54 between the pressurization communal air chamber 51 and the pressurization pressure regulation valve 53. The "Vkn" is a capacity of a portion of the pressurization and depressurization communicating pipe 62 between the pressurization communal air chamber 51 and the pressurization and depressurization communicating valve 61. The "Vkp" is a capacity of a portion of the air pump pipe 72 between the pressurization communal air chamber 51 and the air pump 71.

The air volume Vf1 of the depressurization system is an air volume that is associated with portions communicated with the depressurization tanks 24 in the ink circulating mode and generates the preset pressure Pfs together with the depressurization tanks 24. The air volume Vf1 of the depressurization system is indicated by a following equation (3).

$$Vf1 = 4 \times Vft + Vfc + 4 \times Vfr + Vfb + Vfn + Vfi \quad (3)$$

The "Vft" is a capacity of the air space 39 in the depressurization tank 24. The "Vft" corresponds to a volume of a space higher than the reference height level of the liquid level in the depressurization tank 24. The "Vfc" is a capacity of the depressurization communal air chamber 56. The "Vfr" is a capacity of the depressurization communicating pipe 57. The "Vfb" is a capacity of a portion of the depressurization pressure regulation pipe 59 between the depressurization communal air chamber 56 and the depressurization pressure regulation valve 58. The "Vfn" is a capacity of a portion of the pressurization and depressurization communicating pipe 62 between the depressurization communal air chamber 56 and the pressurization and depressurization communicating valve 61. The "Vfi" is a capacity of a portion of the depressurization pipe 74 between the depressurization communal air chamber 56 and the depressurization valve 73.

Returning to the description of the inkjet printer 1 with reference to FIG. 1, the transfer unit 4 picks up a paper from a paper feed tray (not shown), and then transfers the paper along a transfer path. The transfer unit 4 has rollers for transferring papers, motors for driving the rollers and so on (any of them are not shown).

The controller 5 controls operations of components of the inkjet printer 1. The controller 5 is configured by including a CPU, a RAM, a ROM and so on.

During printing, the controller 5 controls the print units 2 and the pressure generator 3 to eject ink from the inkjet heads 11 while circulating ink in the ink circulator 12. In a waiting mode without circulating ink, the controller 5 makes the pressurization tanks 21 and the depressurization tanks 24 into the hermetically-sealed state that is a state of being hermetically sealed from atmosphere by closing the pressurization pressure regulation valve 53, the depressurization pressure regulation valve 58 and the depressurization valve 73, and makes the collection tanks 25 into the atmospherically-released state that is a state of being atmospherically released by opening the collection atmospheric release valve 67.

Figure 3:
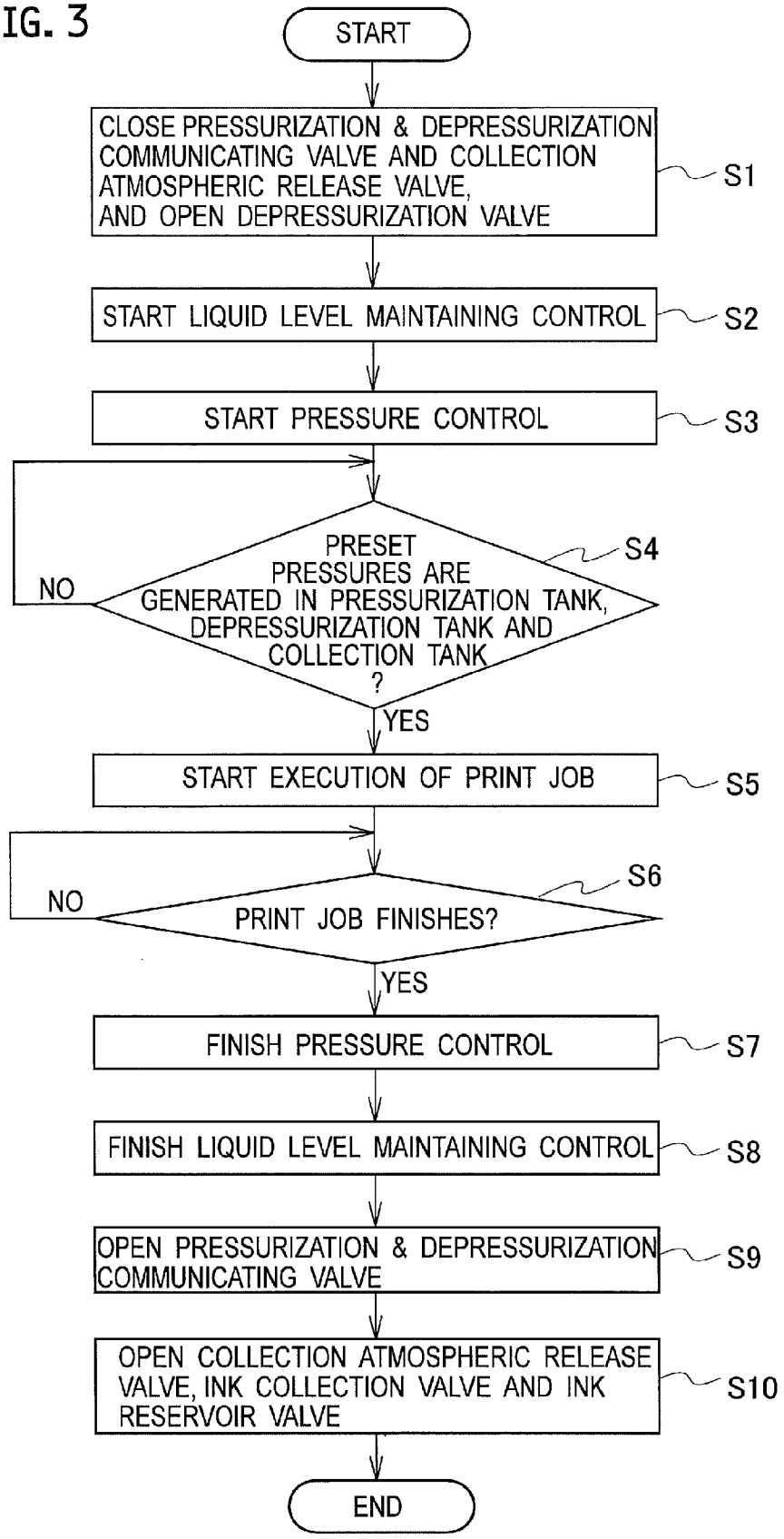
FIG. 3 is a flowchart for explaining operations of the inkjet printer.

Next, operations of the inkjet printer 1 will be described with reference to FIG. 3. A process flow of a flowchart shown in FIG. 3 is started when a print job is input to the inkjet printer 1.

The controller 5 closes the depressurization communicating valve 61 and the collection atmospheric release valve 67, and opens the depressurization valve 73 (step S1). Communication between the pressurization communal air chamber 51 and the depressurization communal air chamber 56 is blocked by closing the depressurization communicating valve 61. In addition, the depressurization communal air chamber 56 and the collection communal air chamber 63 are communicated with each other by opening the depressurization valve 73. Further, the collection communal air chamber 63 and the collection tank 25 are hermetically sealed from atmosphere by closing the collection atmospheric release valve 67.

Note that, in the waiting mode, the pressurization and depressurization communicating valve 61 and the collection atmospheric release valve 67 are opened, and the depressurization valve 73 is closed. In addition, the pressurization pressure regulation valve 53, the depressurization pressure regulation valve 58 and the collection pressure regulation valve 65 are closed. Further, the ink collection valve 30 and the ink reservoir valve 47 are opened.

Subsequently, the controller 5 starts a liquid level maintaining control (step S2). The liquid level maintaining control is a control for maintaining liquid levels in the pressurization tank(s) 21, the depressurization tank(s) 24 and the collection tank(s) 25 at almost their reference height levels, respectively. In the liquid level maintaining control, the controller 5 controls the ink circulation pump 31, the ink collection valve 30 and the ink reservoir valve 47 according to the liquid levels in the pressurization tank(s) 21, the depressurization tank(s) 24 and the collection tank(s) 25.

Specifically, as shown in a following [Table 1], when the pressurization tank liquid level sensor 37 outputs an "OFF" signal, the controller 5 turns the ink circulation pump 31 on (drives the ink circulation pump 31). On the other hand, when the pressurization tank liquid level sensor 37 outputs an "ON" signal, the controller 5 turns the ink circulation pump 31 off (stops the ink circulation pump 31).

TABLE 1

| Condition | Ink Circulation Pump |
|---|---|
| Pressurization Tank Liquid Level Sensor: OFF | Turned On |
| Pressurization Tank Liquid Level Sensor: ON | Turned Off |

In addition, as shown in a following [Table 2], when the depressurization tank liquid level sensor 40 outputs the "OFF" signal, the controller 5 closes the ink collection valve 30. On the other hand, when the depressurization tank liquid level sensor 40 outputs the "ON" signal, the controller 5 opens the ink collection valve 30.

TABLE 2

| Condition | Ink Collection Valve |
|---|---|
| Depressurization Tank Liquid Level Sensor: OFF | Closed |
| Depressurization Tank Liquid Level Sensor: ON | Opened |

Further, as shown in a following [Table 3], when the collection tank liquid level sensor 42 outputs the "OFF" signal, the controller 5 opens the ink reservoir valve 47. On the other hand, when the collection tank liquid level sensor 42 outputs the "ON" signal, the controller 5 closes the ink reservoir valve 47.

TABLE 3

| Condition | Ink Reservoir Valve |
|---|---|
| Collection Tank Liquid Level Sensor: OFF | Opened |
| Collection Tank Liquid Level Sensor: ON | Closed |

Returning to the description of the operations of the inkjet printer 1 with reference to FIG. 3, the controller 5 starts a pressure control (step S3). The pressure control is a control for generating the preset pressures Pks, Pfs and Prs in the pressurization tank(s) 25, the depressurization tank(s) 24 and the collection tank(s) 25, respectively, and maintaining them. Here, the preset pressure Prs of the collection tank 25 is a negative pressure smaller than the preset pressure Pfs of the depressurization tank 24 (i.e. an absolute value of the Prs is larger than that of the Pfs). The preset pressure Prs of the collection tank 25 is set as a pressure value for sending ink from the depressurization tank 24 to the collection tank 25 by use of a pressure difference between the depressurization tank 24 and the collection tank 25.

In the pressure control, the controller 5 controls the air pump 71, the pressurization pressure regulation valve 53, the depressurization valve 73, the depressurization pressure regulation valve 58 and the collection pressure regulation valve 65 according to a pressure Pk in the pressurization tank 21, a pressure Pf in the depressurization tank 24 and a pressure Pr in the collection tank 25 that are detected.

Specifically, as shown in a following [Table 4], when Pk<Pks and |Pr|<|Prs|, the controller 5 turns the air pump 71 on (drives the air pump 71), and closes the pressurization pressure regulation valve 53 and the collection pressure regulation valve 65. As the result, air is suctioned, by the air pump 71, from the collection communal air chamber 63 in the hermetically-sealed state, and thereby pressure in the collection tank 25 decreases (i.e. an absolute value of its negative pressure increases). In addition, the air is sent, by the air pump 71, to the pressurization communal air chamber 51 in the hermetically-sealed state, and thereby pressure in the pressurization tank 21 increases.

TABLE 4

| Condition | Air Pump | Pressurization Pressure Regulation Valve | Depressurization Pressure Regulation Valve |
|---|---|---|---|
| Pk < Pks and \|Pr\| < \|Prs\| | Turned On | Closed | Closed |
| Pk < Pks and \|Pr\| ≥ \|Prs\| | Turned On | Closed | Opened |
| Pk ≥ Pks and \|Pr\| < \|Prs\| | Turned On | Opened | Closed |
| Pk ≥ Pks and \|Pr\| ≥ \|Prs\| | Turned Off | Opened | Opened |

When Pk<Pks and |Pr|≥|Prs|, the controller 5 turns the air pump 71 on. In addition, the controller 5 closes the pressurization pressure regulation valve 53, and opens the collection pressure regulation valve 65. As the result, air is sent, by the air pump 71, to the pressurization communal air chamber 51 in the hermetically-sealed state, and thereby pressure in the pressurization tank 21 increases. In addition, air flows into the collection communal air chamber 63 through the collection pressure regulation pipe 66 by opening the collection pressure regulation valve 65, and thereby pressure in the collection tank 25 increases (i.e. an absolute value of its negative pressure decreases).

When Pk≥Pks and |Pr|<|Prs|, the controller 5 turns the air pump 71 on, opens the pressurization pressure regulation valve 53, and closes the collection pressure regulation valve 65. As the result, air is suctioned, by the air pump 71, from the collection communal air chamber 63 in the hermetically-sealed state, and thereby pressure in the collection tank 25 decreases (i.e. an absolute value of its negative pressure increases). In addition, air flows out from the pressurization communal air chamber 51 through the pressurization pressure regulation pipe 54 by opening the pressurization pressure regulation valve 53, and thereby pressure in the pressurization tank 21 decreases.

When Pk≥Pks and |Pr|≥|Prs|, the controller 5 turns the air pump 71 off (stops the air pump 71). In addition, the controller 5 opens the pressurization pressure regulation valve 53 and the collection pressure regulation valve 65. As the result, air flows out from the pressurization communal air chamber 51 through the pressurization pressure regulation pipe 54, and thereby pressure in the pressurization tank 21 decreases. In addition, air flows into the collection communal air chamber 63 through the collection pressure regulation pipe 66, and thereby pressure in the collection tank 25 increases (i.e. an absolute value of its negative pressure decreases).

In addition, as shown in a following [Table 5], when |Pf|<|Pfs|, the controller 5 opens the depressurization valve 73, and closes the depressurization pressure regulation valve 58. As the result, air is suctioned from the depressurization communal air chamber 56 in the hermetically-sealed state through the depressurization pipe 74, and thereby pressure in the depressurization tank 24 decreases (i.e. an absolute value of its negative pressure increases).

TABLE 5

| Condition | Depressurization Valve | Depressurization Pressure Regulation Valve |
|---|---|---|
| \|Pf\| < \|Pfs\| | Opened | Closed |
| \|Pf\| ≥ \|Pfs\| | Closed | Opened |

When |Pf|≥|Pfs|, the controller 5 closes the depressurization valve 73, and opens the depressurization pressure regulation valve 58. As the result, air flows into the depressurization communal air chamber 56 through the depressurization pressure regulation pipe 59, and thereby pressure in the depressurization tank 24 increases (i.e. an absolute value of its negative pressure decreases).

Returning to the description of the operations of the inkjet printer 1 with reference to FIG. 3, the controller 5 determines whether or not the preset pressure Pks, Pfs and Prs are generated in the pressurization tank 21, the depressurization tank 24 and the collection tank 25, respectively (step S4). While it is judged that no preset pressure is generated in at least one of the pressurization tank 21, the depressurization tank 24 and the collection tank 25 (NO in step S4), the controller 5 executes the process of the step S4 repeatedly.

When it is judged that each preset value is generated in the pressurization tank 21, the depressurization tank 24 and the collection tank 25 (YES in step S4), the controller 5 starts execution of a print job (step S5). Specifically, the controller 5 prints images on a paper transferred by the transfer unit 4 by ejecting ink from inkjet heads 11 based on the print job.

During the execution of the print job, ink is supplied from the pressurization tank 21 to the inkjet head 11, and ink that is not consumed by the inkjet head 11 is collected to the depressurization tank 24. When the pressurization tank liquid level sensor 37 outputs an "OFF" signal due to outflows of ink from the pressurization tank 21 to the inkjet head 11, the ink circulation pump 31 sends ink from the collection tank 25 to the pressurization tank 21 by the liquid level maintaining control. When the depressurization tank liquid level sensor 40 outputs an "ON" signal due to inflows of ink into the depressurization tank 24 from the inkjet head 11, the ink collection valve 30 is opened to supply ink from the depressurization tank 24 to the collection tank 25. In this manner, printing is done while circulating ink.

In addition, when the collection tank liquid level sensor 42 outputs an "OFF" signal due to supplies of ink from the collection tank 25 to the pressurization tank 21, the ink reservoir valve 47 is opened to replenish ink from the ink cartridge 46 to the collection tank 25.

After the execution of the print job is started, the controller 5 monitors whether or not the print job is finished (step S6). While it is determined that the print job is not yet finished (NO in step S6), the controller 5 executes the process of the step S6 repeatedly.

When it is determined that the print job is finished (YES in step S6), the controller 5 finished the pressure control (step S7). If the air pump 71 is being driven at this time, the controller 5 stops it. In addition, if any of the pressurization pressure regulation valve 53, the depressurization pressure regulation valve 58, the collection pressure regulation valve 65 and the depressurization valve 73 is still opened, the controller 5 closes an opened valve(s) of them and keeps a closed valve(s) of them in their closed state.

Subsequently, the controller 5 finishes the liquid level maintaining control (step S8). If the ink circulation pump 31 is being driven at this time, the controller 5 stops it.

In addition, if any of the ink collection valve 30 and the ink reservoir valve 47 is still opened, the controller 5 closes an opened valve(s) of them.

The ink circulation in the ink circulator 12 is finished by the completions of the pressure control and the liquid level maintaining control.

Subsequently, the controller 5 opens the pressurization and depressurization communicating valve 61 (step S9). Since the air volume Vk1 of the pressurization system and the air volume Vf1 of the depressurization system are designed in the inkjet printer 1 so that the above-mentioned equation (1) is satisfied, positive pressure of the pressurization system and negative pressure of the depressurization system are offset with each other by opening the pressurization and depressurization communicating valve 61. As the result, pressures in the pressurization tank 21 and the depressurization tank 24 become atmospheric pressure substantially.

Subsequently, the controller 5 opens the collection atmospheric release valve 67, the ink collection valve 30 and the ink reservoir valve 47 (step S10). As the result, a series of the operations are finished, and thereby the inkjet printer 1 is changed into the waiting mode.

While the inkjet printer 1 is in the waiting mode, the pressurization tank 21 and the depressurization tank 24 are in the hermetically-sealed state that is hermetically sealed from atmosphere. On the other hand, the collection tank 25 is in the atmospherically-released state. Therefore, in the waiting mode, a nozzle pressure Pn of the inkjet head 11 stays at a pressure depending on a level difference (water head difference) H between a liquid level of ink in the collection tank 25 and the nozzle surfaces 16*a*. Specifically, the nozzle pressure Pn in the waiting mode is indicated by a following equation (4).

$$Pn=-\rho\times g\times H \tag{4}$$

The "ρ" is ink density, and the "g" is the gravity acceleration. The reason why the nozzle pressure Pn presents a negative value (is negative pressure) is that the collection tank 25 is disposed below the nozzle surfaces 16*a*.

The collection tank 25 is disposed at a height level such that the nozzle pressure Pn in the waiting mode doesn't exceed a meniscus break pressure. The meniscus break pressure is determined according to a diameter of the nozzle and surface tension of ink.

As described above, the inkjet printer 1 is provided with the collection tank(s) 25. In the waiting mode, the controller 5 makes the pressurization tank(s) 21 and the depressurization tank(s) 24 into the hermetically-sealed state by closing the pressurization pressure regulation valve 53, the depressurization pressure regulation valve 58 and the depressurization valve 73, and makes the collection tank(s) 25 into the atmospherically-released state by opening the collection atmospheric release valve 67.

Therefore, the nozzle pressure Pn of the inkjet head(s) 11 in the waiting mode is determined according to the height level difference H between a liquid level in the collection tank(s) 25 that is atmospherically released and the nozzle surfaces 16*a*. As the result, even if atmospheric pressure changes due to an environment change, the nozzle pressure Pn is restricted from changing and thereby ink-leaking from the nozzles and air-suctioning through the nozzles due to the meniscus break can be restricted. According to the inkjet printer 1, ink-leaking from the nozzles and air-suctioning through the nozzles in the waiting mode can be restricted.

In the inkjet printer 1, the collection tank 25 is disposed on a path from the depressurization tank 24 to the pressurization tank 21. In the ink circulating mode, the collection tank 25 is made into the hermetically-sealed state by closing the collection atmospheric release valve 67, and negative pressure is generated therein. In the waiting mode, the collection tank 25 is made into the atmospherically-released state by opening the collection atmospheric release valve 67. Therefore, with the configuration of disposing the collection tank 25 on the ink circulation path, it becomes possible to supply ink from the depressurization tank 24 to the collection tank 25 in the ink circulating mode by use of negative pressure in the collection tank 25 and to determine the nozzle pressure in the waiting mode according to the height level difference H between a liquid level in the collection tank 25 and the nozzle surfaces 16*a*.

In the inkjet printer 1, since the pressurization tank 21 and the depressurization tank 24 are disposed above the inkjet head 11, the pressurization tank 21 and the depressurization tank 24 are not protruded downward from the inkjet head 11. Therefore, flexibility in layout of components such as a maintenance mechanism (not shown) for cleaning the nozzle surfaces 16*a* of the inkjet head 11 can be improved.

In addition, in the inkjet printer 1, the heatsink 32 is disposed on the ink circulation pipe 28 between the depressurization tank 24 and the collection tank 25, and the heater 33 is disposed on the ink circulation pipe 29 between the pressurization tank 21 and the collection tank 25. Therefore, even if a configuration in which the head holder 17 is needed to be moved for doing maintenance of the inkjet head 11 is adopted, it becomes possible to prevent the heatsink 32 and the heater 33 that may have heavyweights from moving for the maintenance.

Further, in the inkjet printer 1, since the collection tank 25 is disposed below the nozzle surfaces 16*a*, the nozzle pressure Pn in the waiting mode can be set as negative pressure. Therefore, even in a case where the nozzles are damaged such as being scratched, ink-leaking from the nozzles can be restricted. As the result, ink-leaking in the waiting mode can be restricted more effectively.

Furthermore, in the inkjet printer 1, the pressurization tank 21 and the depressurization tank 24 are connected with each other via the pressurization and depressurization communicating valve 61 that is a normal-open type electromagnetic valve. When the pressurization and depressurization communicating valve 61 is opened in the ink circulating mode where positive pressure (the preset pressure Pks) is generated in the pressurization tank 21 and negative pressure (the preset pressure Pfs) is generated in the depressurization tank 24, the positive pressure in the pressurization tank 21 and the negative pressure in the depressurization tank 24 can be offset with each other. Therefore, even if power shutdown occurs in the ink circulating mode, the pressures in the pressurization tank 21 and the depressurization tank 24 can be relieved (offset with each other) due to opening of the normal-open type pressurization and depressurization communicating valve 61.

Figure 4:
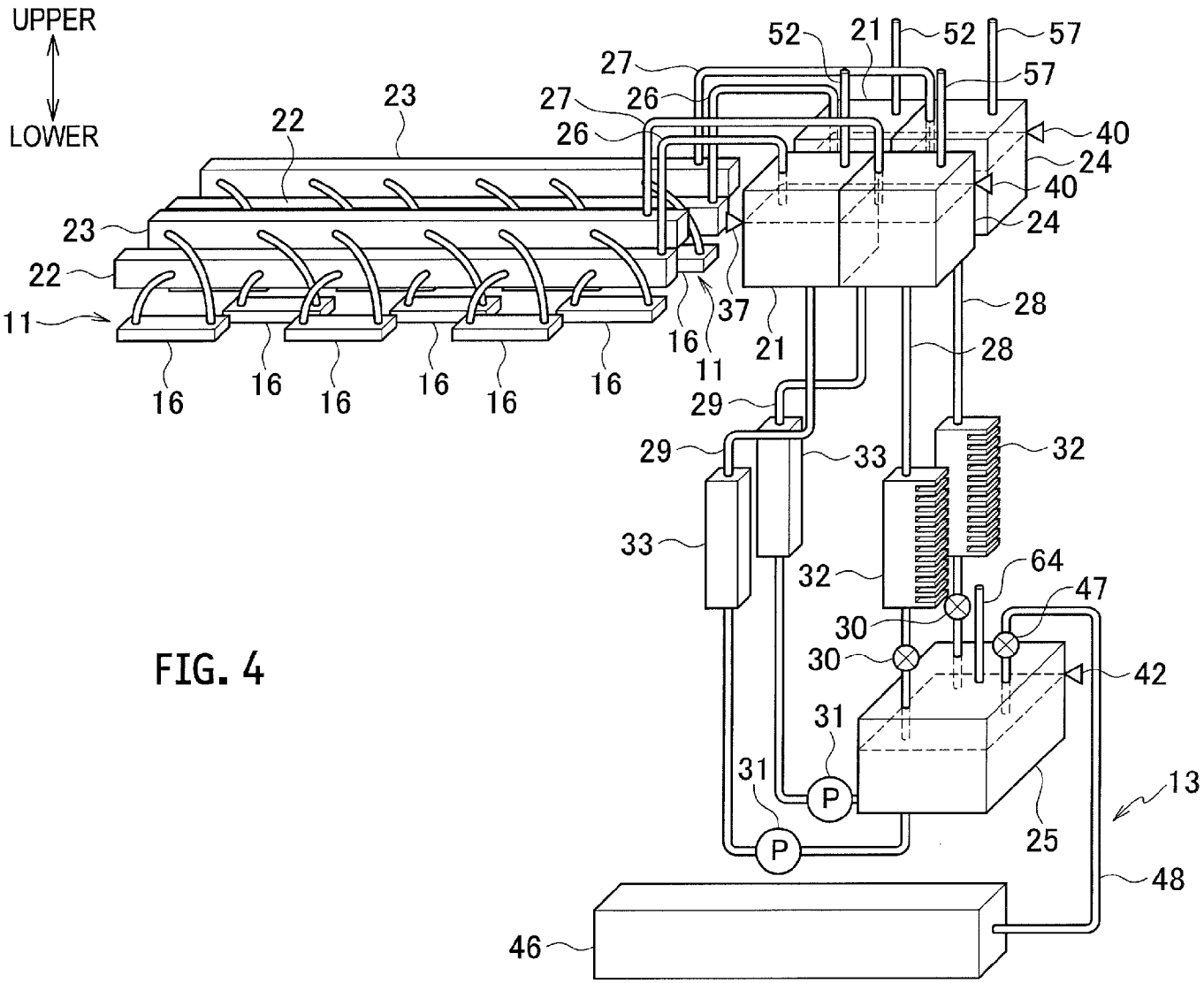
FIG. 4 is a perspective view showing a modified example of the print unit.

Note that, in each of the print units 2, the inkjet head 11 and every component of the ink circulator 12 other than the collection tank 25 may be provided in a plurality with respect to the single collection tank 25. For example, as shown in FIG. 4, the inkjet heads 11, the pressurization tank 21, the distributor 22, the collector 23, the depressurization tank 24, the set of the ink circulation pipes 26 to 29, the ink collection valve 30, the ink circulation pump 31, the heatsink 32 and the heater 33 may be provided in a pair with respect to the single collection tank 25.

By making the single collection tank 25 communal for the plural inkjet heads 11, it become possible to establish a configuration provided with the plural inkjet heads 11 for a single ink color without complicating a configuration of the inkjet printer 1.

Note that, also in this case, an air volume of the pressurization system and an air volume of the depressurization system are designed so that positive pressure of the pressurization system and negative pressure of the depressurization system are offset with each other when the pressurization and depressurization communicating valve 61 is opened at the completion of the ink circulation.

Second Embodiment

Next, an inkjet printer according to a second embodiment whose print unit(s) 2A and pressure generator 3A are changed from the print unit(s) 2 and the pressure generator 3 in the above-described first embodiment will be described.

Figure 5:
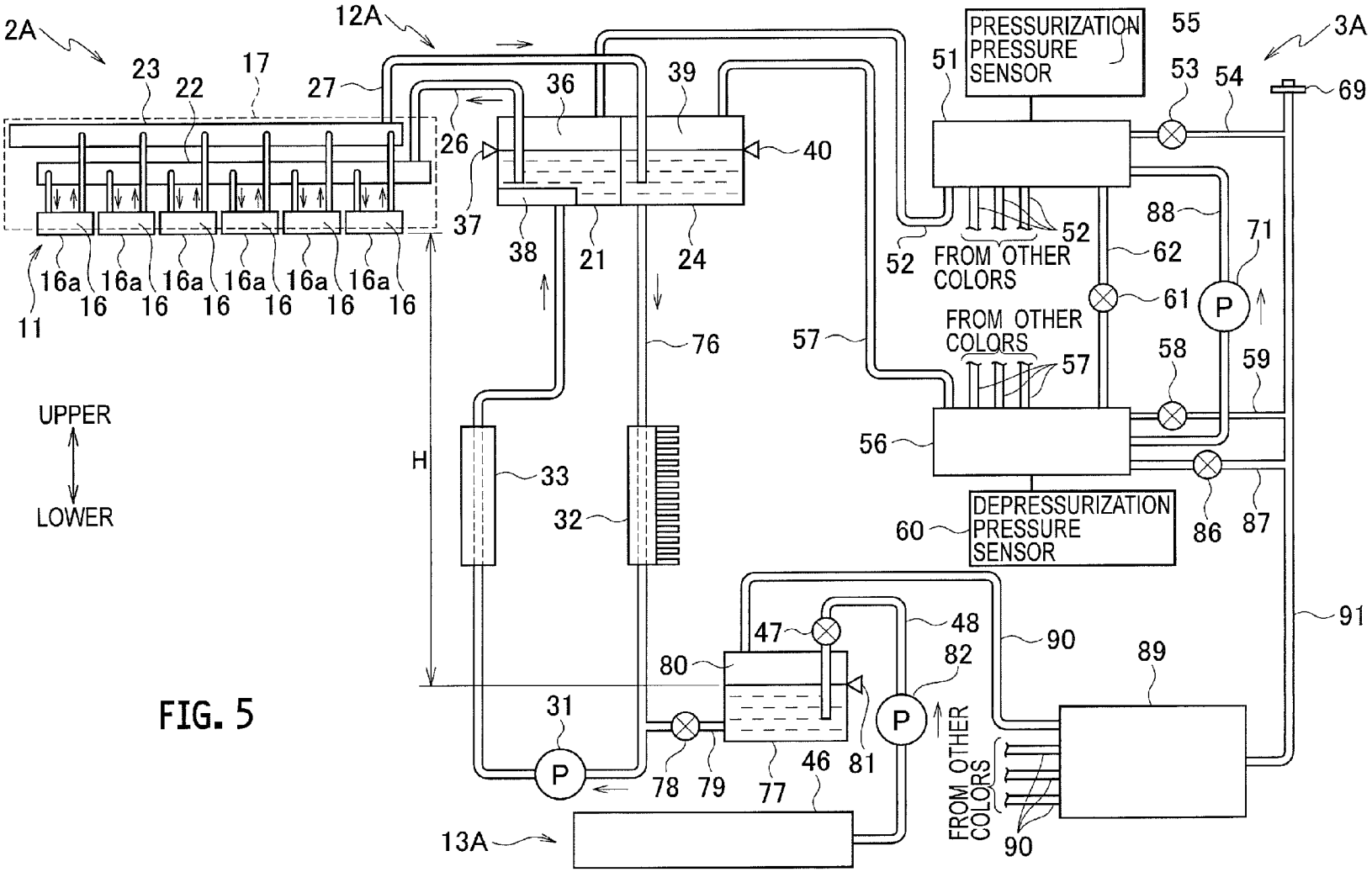
FIG. 5 is a schematic configuration diagram of a print unit and a pressure generator of an inkjet printer according to a second embodiment.

As shown in FIG. 5, the print unit 2A has a configuration in which the ink circulator 12 and the ink reservoir 13 of the above first embodiment are replaced with an ink circulator 12A and an ink reservoir 13A.

Compared with the ink circulator 12 of the first embodiment, in the ink circulator 12A according to the present embodiment, the ink circulation pipe 28 of the above first embodiment is replaced with an ink circulation pipe 76. In addition, the ink circulation pipe 29, the collection tank 25, and the ink collection valve 30 of the first embodiment are omitted. Further, a sub-tank (that corresponds to a third tank recited in claims) 77, a sub-tank valve 78 and a connecting pipe (that corresponds to a connecting path recited in claims) 79 are provided.

The ink circulation pipe 76 connects the pressurization tank 21 and the depressurization tank 24 with each other. In the ink circulator 12A, the ink circulation path is comprised of the ink circulation pipes 26, 27 and 76, the distributor 22, and the collector 23.

The ink circulation pump 31, the heatsink 32 and the heater 33 are disposed on the ink circulation pipe 76. The ink circulation pump 31 sends ink from the depressurization tank 24 to the pressurization tank 21.

The sub-tank 77 stores ink to be supplied to the depressurization tank 24. The sub-tank 77 receives ink supplied from the ink reservoir 13A, and then stores the supplied ink. The sub-tank 77 is indirectly connected with the ink circulation pipe 76 by interposing the connecting pipe 79 therebetween. In the sub-tank 77, an air space 80 is formed above a liquid surface of the ink. The sub-tank 77 is connected with an after-described sub-tank communal air chamber 89 via an after-described sub-tank communicating pipe 90. The sub-tank 77 is disposed at a lower height level than (below) the nozzle surfaces 16*a* of the head modules 16 of the inkjet head 11.

A sub-tank liquid level sensor 81 is provided in the sub-tank 77. The sub-tank liquid level sensor 81 detects whether or not a liquid level of the ink in the sub-tank 77 reaches a reference height level. The sub-tank liquid level sensor 81 outputs an "ON" signal when the liquid level in the sub-tank 77 stays at the reference height level or is higher than the reference height level, and outputs an "OFF" signal when the liquid level is lower than the reference height level.

The sub-tank valve 78 opens or closes an ink flow path in the connecting pipe 79 to change over communication or non-communication between the ink circulation pipe 76 and the sub-tank 77. The sub-tank valve 78 is provided on the middle of the connecting pipe 79. The sub-tank valve 78 is a normal-open type electromagnetic valve.

The connecting pipe 79 forms the ink flow path for communicating the ink circulation pipe 76 and the sub-tank 77 with each other. One end of the connecting pipe 79 is connected with the ink circulation pipe 76 between the depressurization tank 24 and the ink circulation pump 31, and another end thereof is connected with the sub-tank 77.

The ink reservoir 13A has a configuration established by adding an ink reservoir pump 82 to the ink reservoir 13 of the first embodiment.

The ink reservoir pipe 48 of the ink reservoir 13A connects the ink cartridge 46 and the sub-tank 77 with each other. In addition, the ink reservoir valve 47 of the ink reservoir 13A is a normal-open type electromagnetic valve.

The ink reservoir pump 82 supplies ink from the ink cartridge 46 to the sub-tank 77. The ink reservoir pump 82 is disposed on the middle of the ink reservoir pipe 48.

The pressure generator 3A generates pressures used for circulating ink in the pressurization tank 21 and the depressurization tank 24 of each of the print units 2A. As shown in FIG. 5, in the pressure generator 3A, a depressurization atmospheric release valve 86, and a depressurization atmospheric release pipe 87 are added to the pressure generator 3 of the first embodiment. In addition, the air pump pipe 72, the collection communal air chamber 63, the collection communicating pipes 64, and the collection atmospheric release pipe 68 of the first embodiment are replaced with an air pump pipe 88, a sub-tank communal air chamber 89, sub-tank communicating pipes 90, and a sub-tank atmospheric release pipe 91. Further, the collection pressure regulation valve 65, the collection pressure regulation pipe 66, the collection atmospheric release valve 67, the collection pressure sensor 70, the depressurization valve 73, and the depressurization pipe 74 of the first embodiment are omitted.

The depressurization atmospheric release valve 86 opens or closed an air flow path in the depressurization atmospheric release pipe 87 in order to change over the depressurization communal air chamber 56 and the depressurization tank 24 between a hermetically-sealed state and an atmospherically-released state. The depressurization atmospheric release valve 86 is disposed on the middle of the depressurization atmospheric release pipe 87. The depressurization atmospheric release valve 86 is a normal-open type electromagnetic valve.

The depressurization atmospheric release pipe 87 forms an air flow path for atmospherically purging the depressurization communal air chamber 56 and the depressurization tank 24. One end of the depressurization atmospheric release pipe 87 is connected with the depressurization communal air chamber 56, and another end thereof is connected with the sub-tank atmospheric release pipe 91.

Here, in a case of purging ink from the nozzles for maintenances of the inkjet heads 11, the depressurization communal air chamber 56 and the depressurization tank 24 are atmospherically released. In this case, the depressurization atmospheric release valve 86 is opened, and air is supplied from the depressurization communal air chamber 56 to the pressurization communal air chamber 51 by the air pump 71 while the pressurization pressure regulation valve 53 and the pressurization and depressurization communicating valve 61 are being closed. As the result, the pressure in the pressurization tanks 21 is increased, and thereby ink is purged from the nozzles of the inkjet heads 11.

The air pump pipe 88 forms an air flow path for sending air from the depressurization communal air chamber 56 to the pressurization communal air chamber 51 by the air pump 71. One end of the air pump pipe 88 is connected with the depressurization communal air chamber 56, and another thereof is connected with the pressurization communal air chamber 51. The air pump 71 is disposed on the middle of the air pump pipe 88.

The sub-tank communal air chamber 89 is a communal air chamber for making the sub-tank 77 of the print unit(s) 2A into the atmospherically-released state. The sub-tank communal air chamber 89 is always in the atmospherically-released state via the sub-tank atmospheric release pipe 91. The sub-tank communal air chamber 89 is communicated with the air spaces 80 in the sub-tanks 77 of the four print units 2A via the four sub-tank communicating pipes 90, respectively. Therefore, the sub-tanks 77 of all the print units 2A are all atmospherically released.

Each of the sub-tank communicating pipes 90 communicates the sub-tank communal air chamber 89 with the air space 80 in the sub-tank 77. The four sub-tank communicating pipes 90 are provided so that they are associated with the print units 2A one for one. One end of the sub-tank communicating pipe(s) 90 is connected with the sub-tank communal air chamber 89, and another end thereof is connected with the air space 80 in the sub-tank 77.

The sub-tank atmospheric release pipe 91 atmospherically releases the sub-tank communal air chamber 89. One end of the sub-tank atmospheric release pipe 91 is connected with the sub-tank communal air chamber 89, and another end thereof is opened to atmosphere via the air filter 69. The pressurization pressure regulation pipe 54, the depressurization pressure regulation pipe 59 and the depressurization atmospheric release pipe 87 are connected with the sub-tank atmospheric release pipe 91.

Hereinafter, air volume design for a pressurization system and a depressurization system in the print units 2A and the pressure generator 3A will be described.

Also in the second embodiment similarly to the first embodiment, an air volume of the pressurization system and an air volume of the depressurization system are designed so that positive pressure of the pressurization system and negative pressure of the depressurization system are offset with each other when the depressurization communicating valve 61 is opened at the completion of the ink circulation.

Specifically, the air volume Vk2 of the pressurization system and the air volume Vf2 of the depressurization system in the print units 2A and the pressure generator 3A are designed so that a following equation (5) is satisfied by the Boyle's law.

$$Pks \times Vk2 + Pfs \times Vf2 = 0 \quad (5)$$

The air volume Vk2 of the pressurization system is indicated by a following equation (6).

$$Vk2 = 4 \times Vkt + Vkc + 4 \times Vkr + Vkb + Vkn + Vkp \quad (6)$$

The "Vkp" is a capacity of a portion of the air pump pipe 88 between the pressurization communal air chamber 51 and the air pump 71. The "Vkt", the "Vkc", the "Vkr", the "Vkb" and the "Vkn" are the same as those included in the above-described equation (2).

The air volume Vf2 of the depressurization system is indicated by a following equation (7).

$$Vf2 = 4 \times Vft + Vfc + 4 \times Vfr + Vfb + Vfn + Vfq + Vfh \quad (7)$$

The "Vfq" is a capacity of a portion of air pump pipe 88 between the depressurization communal air chamber 56 and the air pump 71. The "Vfh" is a capacity of a portion of the depressurization atmospheric release pipe 87 between the depressurization communal air chamber 56 and depressurization atmospheric release valve 86. The "Vft", the "Vfc", the "Vfr", the "Vfb" and the "Vfn" are the same as those included in the above-described equation (3).

Figure 6:
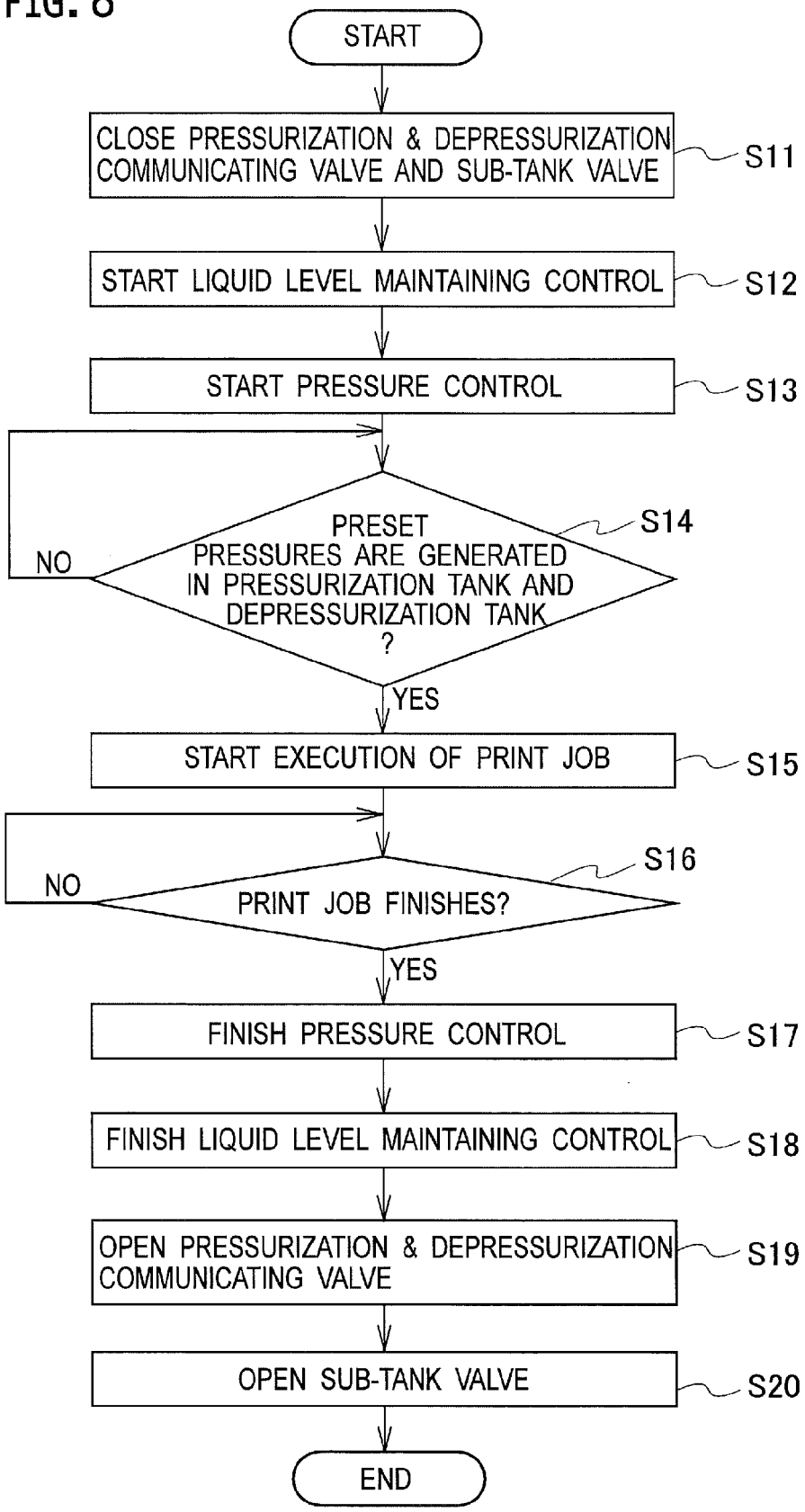
FIG. 6 is a flowchart for explaining operations of the inkjet printer.

Next, operations of the inkjet printer according to the second embodiment will be described with reference to FIG. 6. A process flow of a flowchart shown in FIG. 6 is started when a print job is input to the inkjet printer.

The controller 5 closes the depressurization communicating valve 61 and the sub-tank valve 78 (step S11). Communication between the pressurization communal air chamber 51 and the depressurization communal air chamber 56 is blocked by closing the depressurization communicating valve 61. In addition, communication between the ink circulation pipe 76 and the sub-tank 77 are blocked by closing the sub-tank valve 78.

Note that, in the waiting mode, the depressurization communicating valve 61 and the sub-tank valve 78 are opened. In addition, the pressurization pressure regulation valve 53, the depressurization pressure regulation valve 58, the depressurization atmospheric release valve 86 and the ink reservoir valve 47 are closed.

Subsequently, the controller 5 starts a liquid level maintaining control (step S12). The liquid level maintaining control in the second embodiment is a control for maintaining liquid levels in the pressurization tank(s) 21, the depressurization tank(s) 24 and the sub-tank(s) 77 at almost their reference height levels, respectively. In the liquid level maintaining control, the controller 5 controls the sub-tank valve 78 and the ink circulation pump 31 according to the liquid levels in the pressurization tank(s) 21 and the depressurization tank(s) 24. In addition, the controller 5 controls the ink reservoir valve 47 and the ink reservoir pump 82 according to the liquid level in the sub-tank(s) 77.

Specifically, as shown in a following [Table 6], when both of the pressurization tank liquid level sensor 37 and the depressurization tank liquid level sensor 40 output "OFF" signals, the controller 5 opens the sub-tank valve 78 and turns the ink circulation pump 31 off.

TABLE 6

| Condition | Sub-tank Valve | Ink Circulation Pump |
|---|---|---|
| Pressurization Tank Liquid Level Sensor: OFF<br>Depressurization Tank Liquid Level Sensor: OFF | Opened | Turned Off |
| Pressurization Tank Liquid Level Sensor: ON<br>Depressurization Tank Liquid Level Sensor: OFF | Closed | Turned Off |
| Pressurization Tank Liquid Level Sensor: OFF<br>Depressurization Tank Liquid Level Sensor: ON | Closed | Turned On |
| Pressurization Tank Liquid Level Sensor: ON<br>Depressurization Tank Liquid Level Sensor: ON | Closed | Turned Off |

When the pressurization tank liquid level sensor 37 outputs an "ON" signal and the depressurization tank liquid level sensor 40 outputs an "OFF" signal, the controller 5 closes the sub-tank valve 78 and turns the ink circulation pump 31 off. When the pressurization tank liquid level sensor 37 outputs an "OFF" signal and the depressurization tank liquid level sensor 40 outputs an "ON" signal, the controller 5 closes the sub-tank valve 78 and turns the ink circulation pump 31 on. When both of the pressurization tank liquid level sensor 37 and the depressurization tank liquid level sensor 40 output "ON" signals, the controller 5 closes the sub-tank valve 78 and turns the ink circulation pump 31 off.

In addition, as shown in a following [Table 7], when the sub-tank liquid level sensor 81 outputs an "OFF" signal, the controller 5 opens the reservoir valve 47 and turns the ink reservoir pump 82 on. On the other hand, when the sub-tank liquid level sensor 81 outputs an "ON" signal, the controller 5 closes the reservoir valve 47 and turns the ink reservoir pump 82 off.

TABLE 7

| Condition | Ink Reservoir Valve | Ink Reservoir Pump |
|---|---|---|
| Sub-tank Liquid Level Sensor: OFF | Opened | Turned On |
| Sub-tank Liquid Level Sensor: ON | Closed | Turned Off |

Returning to the description of the operations of the inkjet printer with reference to FIG. 6, the controller 5 starts a pressure control (step S13). The pressure control in the second embodiment is a control for generating the preset pressures Pks and Pfs in the pressurization tank(s) 21 and the depressurization tank(s) 24, respectively, and maintaining them. In the pressure control, the controller 5 controls the air pump 71, the pressurization pressure regulation valve 53 and the depressurization pressure regulation valve 58 according to a pressure Pk in the pressurization tank 21 and a pressure Pf in the depressurization tank 24 that are detected.

Specifically, as shown in a following [Table 8], when Pk<Pks and |Pr|<|Pfs|, the controller 5 closes the pressurization pressure regulation valve 53 and the depressurization pressure regulation valve 58, and turns the air pump 71 on. As the result, air is suctioned, by the air pump 71, from the depressurization tank 24 in the hermetically-sealed state, and thereby pressure in the depressurization tank 24 decreases (i.e. an absolute value of its negative pressure increases). In addition, the air is sent, by the air pump 71, to the pressurization tank 21 in the hermetically-sealed state, and thereby pressure in the pressurization tank 21 increases.

TABLE 8

| Condition | Air Pump | Pressurization Pressure Regulation Valve | Depressurization Pressure Regulation Valve |
|---|---|---|---|
| Pk < Pks and \|Pf\| < \|Pfs\| | Turned On | Closed | Closed |
| Pk ≥ Pks and \|Pf\| < \|Pfs\| | Turned On | Opened | Closed |
| Pk < Pks and \|Pf\| ≥ \|Pfs\| | Turned On | Closed | Opened |
| Pk ≥ Pks and \|Pf\| ≥ \|Pfs\| | Turned Off | Opened | Opened |

When Pk≥Pks and |Pf|<|Pfs|, the controller 5 opens the pressurization pressure regulation valve 53, and closes the depressurization pressure regulation valve 58. In addition, the controller 5 turns the air pump 71 on. As the result, air flows out from the pressurization tank 21 through the pressurization pressure regulation pipe 54, and thereby pressure in the pressurization tank 21 decreases. In addition, air is suctioned, by the air pump 71, from the depressurization tank 24 in the hermetically-sealed state, and thereby pressure in the depressurization tank 24 decreases (i.e. an absolute value of its negative pressure increases).

When Pk<Pks and |Pf|≥|Pfs|, the controller 5 opens the pressurization pressure regulation valve 53, and closes the depressurization pressure regulation valve 58. In addition, the controller 5 turns the air pump 71 on. As the result, air is sent, by the air pump 71, to the pressurization tank 21 in the hermetically-sealed state, and thereby pressure in the pressurization tank 21 increases. In addition, air flows into the depressurization tank 24 through the depressurization pressure regulation pipe 59, and thereby pressure in the depressurization tank 24 increases (i.e. an absolute value of its negative pressure decreases).

When Pk≥Pks and |Pf|≥|Pfs|, the controller 5 opens the pressurization pressure regulation valve 53 and the depressurization pressure regulation valve 58. In addition, the controller 5 turns the air pump 71 off. As the result, air flows out from the pressurization tank 21 through the pressurization pressure regulation pipe 54, and thereby pressure in the pressurization tank 21 decreases. In addition, air flows into the depressurization tank 24 through the depressurization pressure regulation pipe 59, and thereby pressure in the depressurization tank 24 increases (i.e. an absolute value of its negative pressure decreases).

Returning to the description of the operations of the inkjet printer with reference to FIG. 6, the controller 5 determines whether or not the preset pressure Pks and Pfs are generated in the pressurization tank 21 and the depressurization tank 24, respectively (step S14). While it is judged that no preset pressure is generated in the pressurization tank 21 or the depressurization tank 24 (NO in step S14), the controller 5 executes the process of the step S14 repeatedly.

When it is judged that each preset value is generated in the pressurization tank 21 and the depressurization tank 24 (YES in step S14), the controller 5 starts execution of a print job (step S15).

During the execution of the print job, ink is supplied from the pressurization tank 21 to the inkjet head 11, and ink that is not consumed by the inkjet head 11 is collected to the depressurization tank 24. When the pressurization tank liquid level sensor 37 outputs an "OFF" signal and the depressurization tank liquid level sensor 40 outputs an "ON" signal, the ink circulation pump 31 sends ink from the depressurization tank 24 to the pressurization tank 21 by the liquid level maintaining control. In this manner, printing is done while circulating ink.

When ink amount reduced due to ink consumption and both of the pressurization tank liquid level sensor 37 and the depressurization tank liquid level sensor 40 output "OFF" signals, the sub-tank valve 78 is opened by the liquid level maintaining control. As the result, ink is supplied to the depressurization tank 24 due to a pressure difference between the depressurization tank 24 in which negative pressure is generated and the sub-tank 77 in the atmospherically-released state.

In addition, when the sub-tank liquid level sensor 81 outputs an "OFF" signal due to supply of ink from the sub-tank 77 to the depressurization tank 24, the ink reservoir valve 47 is opened and the ink reservoir pump 82 is driven by the liquid level maintaining control. As the result, ink is replenished from the ink cartridge 46 to the sub-tank 77.

After the execution of the print job is started, the controller 5 monitors whether or not the print job is finished (step S16). While it is determined that the print job is not yet finished (NO in step S16), the controller 5 executes the process of the step S16 repeatedly.

When it is determined that the print job is finished (YES in step S16), the controller 5 finished the pressure control (step S17). If the air pump 71 is being driven at this time, the controller 5 stops it. In addition, if any of the pressurization pressure regulation valve 53 and the depressurization pressure regulation valve 58 is still opened, the controller 5 closes an opened valve(s) of them.

Subsequently, the controller 5 finishes the liquid level maintaining control (step S18). If the ink circulation pump 31 is being driven at this time, the controller 5 stops it. In addition, if the sub-tank valve 78 is still opened, the controller 5 closes it. In addition, if the ink reservoir valve 47 is still opened and the ink reservoir pump 82 is being driven, the controller 5 closes the ink reservoir valve 47 and stops the ink reservoir pump 82.

Subsequently, the controller 5 opens the pressurization and depressurization communicating valve 61 (step S19). Since, in the second embodiment, the air volume Vk2 of the pressurization system and the air volume Vf2 of the depressurization system are designed so that the above-mentioned equation (5) is satisfied, positive pressure of the pressurization system and negative pressure of the depressurization system are offset with each other by opening the pressurization and depressurization communicating valve 61. As the result, pressures in the pressurization tank 21 and the depressurization tank 24 become atmospheric pressure substantially.

Subsequently, the controller 5 opens the sub-tank valve 78 (step S20). As the result, a series of the operations are finished, and thereby the inkjet printer is changed into the waiting mode.

While the inkjet printer is in the waiting mode, the pressurization tank 21 and the depressurization tank 24 are in the hermetically-sealed state that is hermetically sealed from atmosphere. Since the sub-tank valve 78 is opened, ink in the sub-tank 77 in the atmospherically-released state is communicated with ink in the ink circulation pipe 76 via the connecting pipe 79.

Therefore, in the waiting mode, the nozzle pressure Pn of the inkjet head 11 stays at a pressure depending on a level difference (water head difference) H between a liquid level of ink in the sub-tank 77 and the nozzle surfaces 16*a*. Namely, the nozzle pressure Pn in the waiting mode is indicated by the above-described equation (4).

The sub-tank 77 is disposed at a height level such that the nozzle pressure Pn in the waiting mode doesn't exceed a meniscus break pressure, similarly to the collection tank 25 in the first embodiment.

As described above, in the waiting mode in the second embodiment, the controller 5 closes the pressurization pressure regulation valve 53, the depressurization pressure regulation valve 58 and the depressurization atmospheric release valve 86 to make the pressurization tank 21 and the depressurization tank 24 in the hermetically-sealed state, and opens the sub-tank valve 78 to communicate the sub-tank 77 and the ink circulation pipe 76 with each other.

Therefore, the nozzle pressure Pn in the waiting mode is determined according to the height level difference H between a liquid level in the sub-tank(s) 77 and the nozzle surfaces 16*a*. As the result, even if atmospheric pressure changes due to an environment change, the nozzle pressure Pn is restricted from changing, similarly to the first embodiment. Namely, also according to the second embodiment, ink-leaking from the nozzles and air-suctioning through the nozzles in the waiting mode can be restricted.

In addition, according to the configuration of indirectly connecting the sub-tank 77 with the ink circulation pipe 76 by interposing the connecting pipe 79 therebetween, the nozzle pressure Pn in the waiting mode can be determined according to the height level difference H between the liquid level in the sub-tank(s) 77 and the nozzle surfaces 16*a* with the configuration of disposing the sub-tank 77 outside the ink circulation path.

Figure 7:
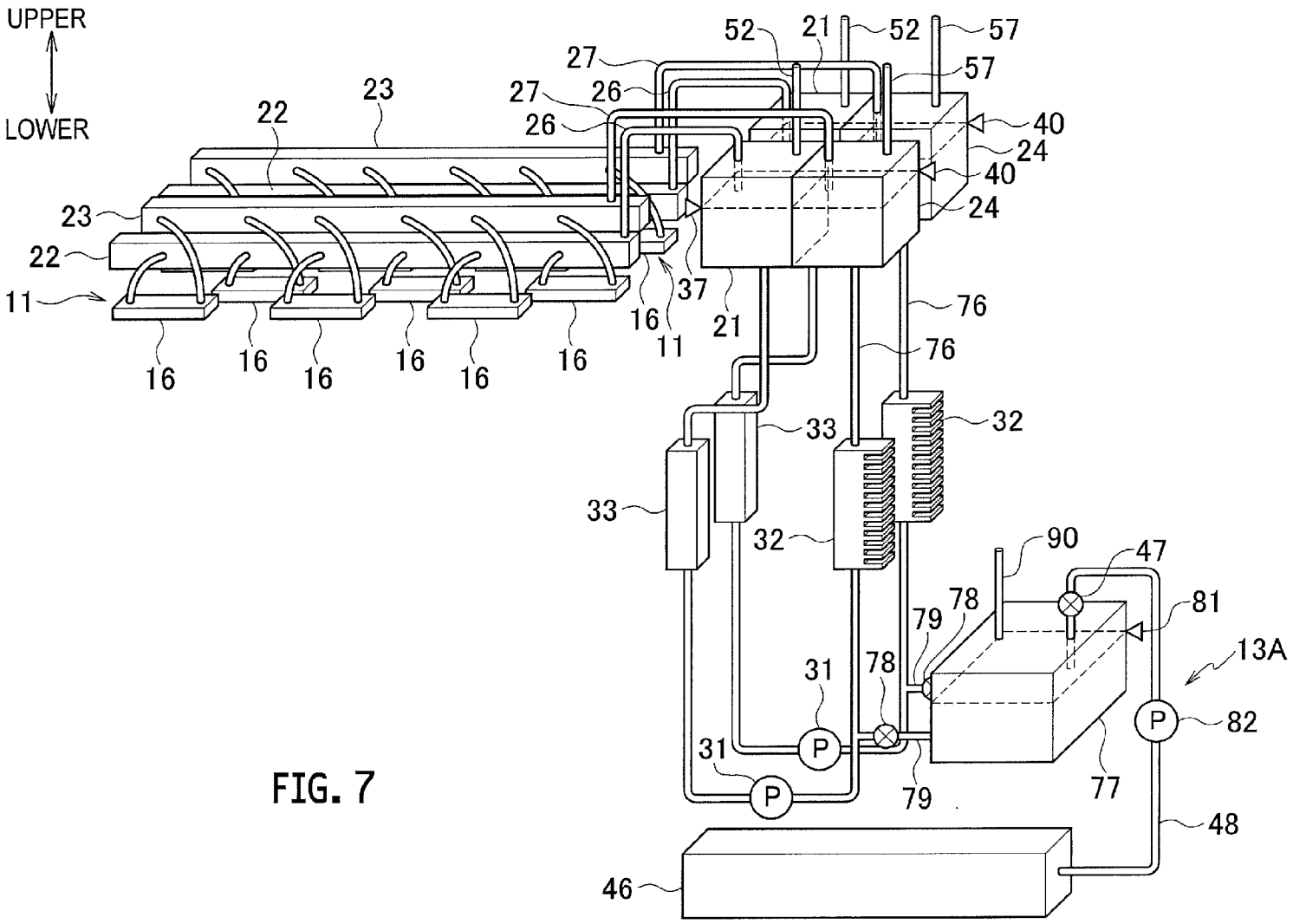
FIG. 7 is a perspective view showing a modified example of the print unit.

Note that, in each of the print units 2A, the inkjet head 11 and every component of the ink circulator 12A other than the sub-tank 77 may be provided in a plurality with respect to the single sub-tank 77. For example, as shown in FIG. 7, the inkjet heads 11, the pressurization tank 21, the distributor 22, the collector 23, the depressurization tank 24, the set of the ink circulation pipes 26, 27 and 76, the sub-tank valve 78, the connecting pipe 79, the ink circulation pump 31, the heatsink 32 and the heater 33 may be provided in a pair with respect to the single sub-tank 77.

By making the single sub-tank 77 communal for the plural inkjet heads 11, it become possible to establish a configuration provided with the plural inkjet heads 11 for a single ink color without complicating configuration of the inkjet printer.

Note that, also in this case, an air volume of the pressurization system and an air volume of the depressurization system are designed so that positive pressure of the pressurization system and negative pressure of the depressurization system are offset with each other when the pressurization and depressurization communicating valve 61 is opened at the completion of the ink circulation.

Third Embodiment

Next, an inkjet printer according to a third embodiment whose print unit(s) 2B is changed from the print unit(s) 2A in the above-described second embodiment will be described.

Figure 8:
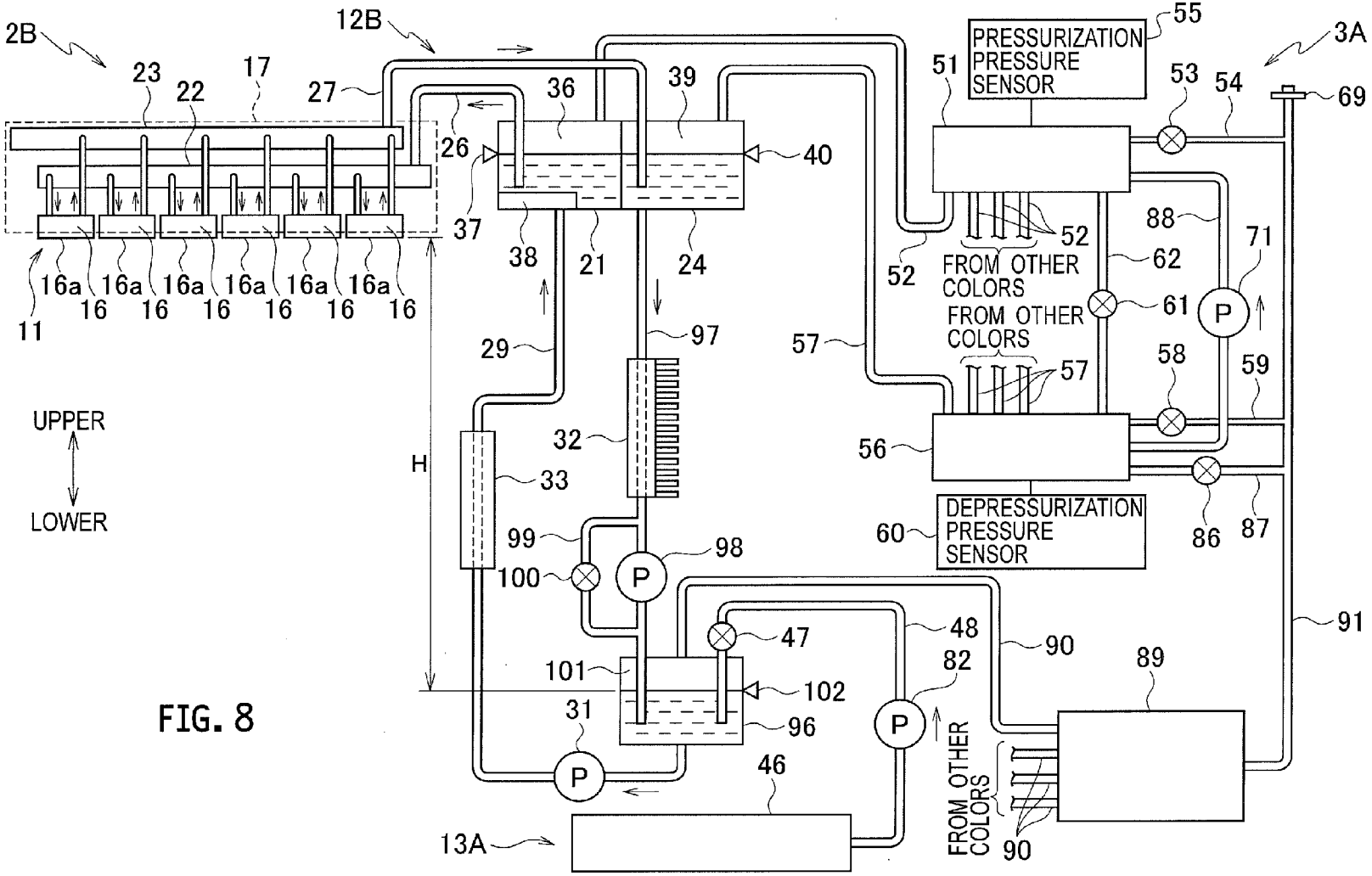
FIG. 8 is a schematic configuration diagram of a print unit and a pressure generator of an inkjet printer according to a third embodiment.

As shown in FIG. 8, the print unit 2B has a configuration in which the ink circulator 12A of the above second embodiment is replaced with an ink circulator 12B.

Compared with the ink circulator 12 of the first embodiment, in the ink circulator 12B according to the present embodiment, the collection tank 25 and the ink circulation pipe 28 of the above first embodiment are replaced with a sub-tank (that corresponds to a third tank recited in claims) 96 and the an ink circulation pipe 97, respectively. In addition, the ink collection valve 30 of the first embodiment is omitted. Further, an ink return pump (that corresponds to a pump recited in claims) 98, a diversion pipe (that corresponds to a diversion path recited in claims) 99 and a diversion valve (that corresponds to a diversion switch recited in claims) 100 are provided.

The sub-tank 96 stores ink to be supplied to the pressurization tank 21. The sub-tank 96 receives ink supplied from the ink reservoir 13A, and then stores the supplied ink. In addition, the sub-tank 96 receives ink from the depressurization tank 24, and then stores it. The sub-tank 96 is connected with the pressurization tank 21 via the ink circulation pipe 29, and connected with the depressurization tank 24 via the ink circulation pipe 97. Therefore, the sub-tank 96 is disposed on a path from the depressurization tank 24 to the pressurization tank 21 in the ink circulation path. In other words, the sub-tank 96 is directly connected with the path from the depressurization tank 24 to the pressurization tank 21 in the ink circulation path. The sub-tank 96 is disposed at a lower height level than (below) the nozzle surfaces 16*a* of the head modules 16 of the inkjet head 11.

In the sub-tank 96, an air space 101 is formed above a liquid surface of the ink. The air space 101 is communicated with the sub-tank communal air chamber 89 via the sub-tank communicating pipe 90 of the pressure generator 3A. Therefore, the sub-tank 96 is always in the atmospherically-released state.

A sub-tank liquid level sensor 102 is provided in the sub-tank 96. The sub-tank liquid level sensor 102 detects whether or not a liquid level of the ink in the sub-tank 96 reaches a reference height level. The sub-tank liquid level sensor 102 outputs an "ON" signal when the liquid level in the sub-tank 96 stays at the reference height level or is higher than the reference height level, and outputs an "OFF" signal when the liquid level is lower than the reference height level.

The ink circulation pipe 97 connects the depressurization tank 24 and the sub-tank 96 with each other. In the ink circulator 12B, the ink circulation path is comprised of the ink circulation pipes 26, 27, 97 and 29, the distributor 22, and the collector 23.

The ink return pump 98 sends ink from the depressurization tank 24 to the sub-tank 96. The ink return pump 98 is disposed on the middle of the ink circulation pipe 97.

The diversion pipe 99 forms a path that diverts the ink return pump 98. One end of the diversion pipe 99 is connected with the ink circulation pipe 97 between the depressurization tank 24 and the ink return pump 98, and another end thereof is connected with the ink circulation pipe 97 between the ink return pump 98 and the sub-tank 96.

The diversion valve 100 opens or closes an ink flow path in the diversion pipe 99. The diversion valve 100 is provided on the middle of the diversion pipe 99. The diversion valve 100 is a normal-open type electromagnetic valve.

Air volume design for a pressurization system and a depressurization system for the print units 2B and the pressure generator 3A in the third embodiment is similar to above-described air volume design for a pressurization system and a depressurization system for the print units 2A and the pressure generator 3A in the second embodiment. Namely, also in the third embodiment, the air volume Vk2 of the pressurization system and the air volume Vf2 of the depressurization system in the print units 2B and the pressure generator 3A are designed so that the above-described equation (5) is satisfied.

Figure 9:
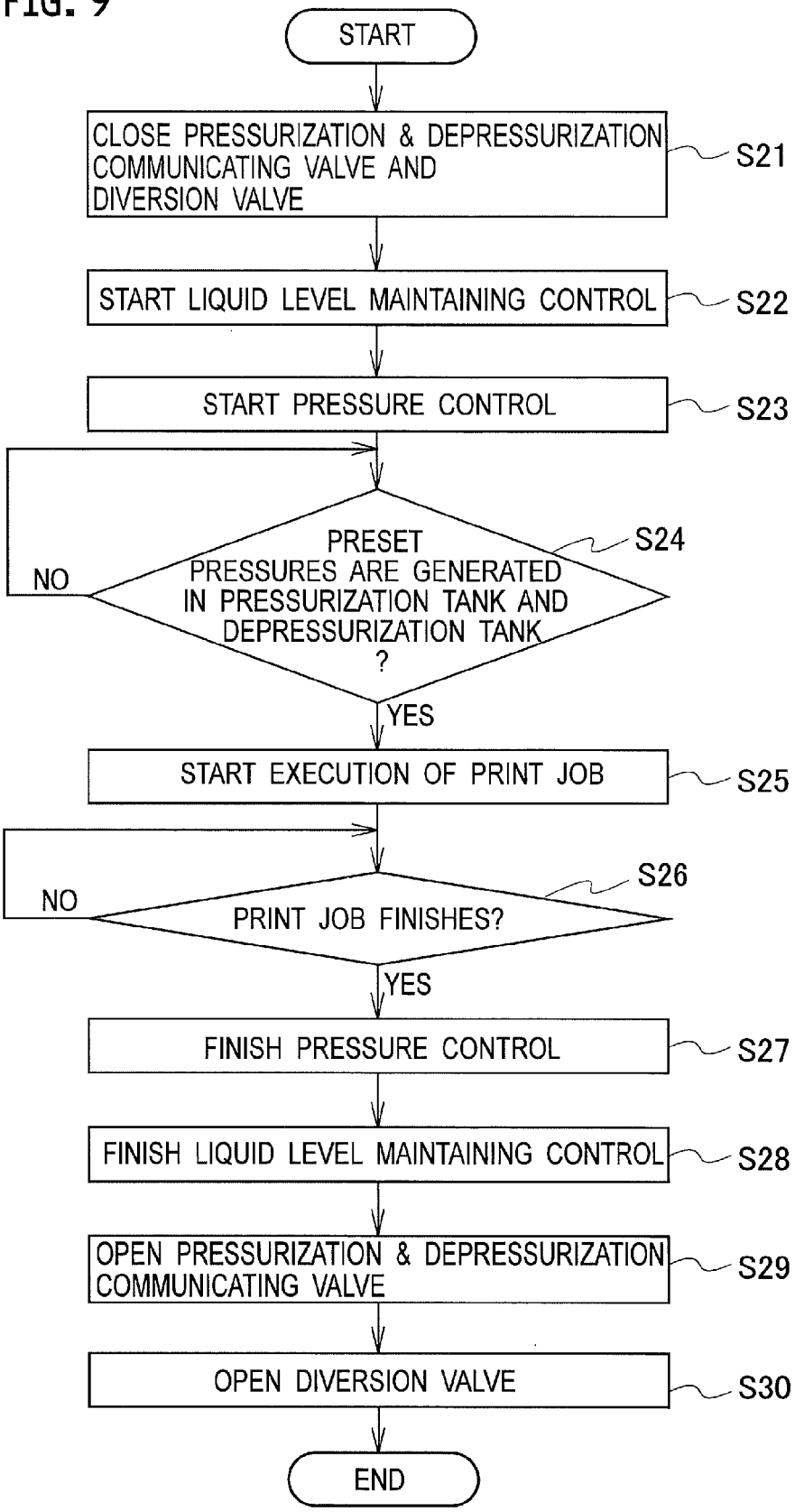
FIG. 9 is a flowchart for explaining operations of the inkjet printer.

Next, operations of the inkjet printer according to the third embodiment will be described with reference to FIG. 9. A process flow of a flowchart shown in FIG. 9 is started when a print job is input to the inkjet printer.

The controller 5 closes the depressurization communicating valve 61 and the diversion valve 100 (step S21). Communication between the pressurization communal air chamber 51 and the depressurization communal air chamber 56 is blocked by closing the depressurization communicating valve 61. In addition, the ink flow path in the diversion pipe 99 is closed by closing the diversion valve 100.

Note that, in the waiting mode, the depressurization communicating valve 61 and the diversion valve 100 are opened. In addition, the pressurization pressure regulation valve 53, the depressurization pressure regulation valve 58, the depressurization atmospheric release valve 86 and the ink reservoir valve 47 are closed.

Subsequently, the controller 5 starts a liquid level maintaining control (step S22). The liquid level maintaining control in the third embodiment is a control for maintaining liquid levels in the pressurization tank(s) 21, the depressurization tank(s) 24 and the sub-tank(s) 96 at almost their reference height levels, respectively. In the liquid level maintaining control, the controller 5 controls the ink circulation pump 31 according to the liquid level in the pressurization tank(s) 21. In addition, the controller 5 controls the ink return pump 98 according to the liquid level in the depressurization tank(s) 24. Further, the controller 5 controls the ink reservoir valve 47 and the ink reservoir pump 82 according to the liquid level in the sub-tank(s) 96.

Specifically, as shown in a following [Table 9], when the pressurization tank liquid level sensor 37 outputs an "OFF" signal, the controller 5 turns the ink circulation pump 31 on. On the other hand, when the pressurization tank liquid level sensor 37 outputs an "ON" signal, the controller 5 turns the ink circulation pump 31 off

TABLE 9

| Condition | Ink Circulation Pump |
|---|---|
| Pressurization Tank Liquid Level Sensor: OFF | Turned On |
| Pressurization Tank Liquid Level Sensor: ON | Turned Off |

In addition, as shown in a following [Table 10], when the depressurization tank liquid level sensor 40 outputs the "OFF" signal, the controller 5 turns the ink return pump 98 off. On the other hand, when the depressurization tank liquid level sensor 40 outputs the "ON" signal, the controller 5 turns the ink return pump 98 on.

TABLE 10

| Condition | Ink Return Pump |
|---|---|
| Depressurization Tank Liquid Level Sensor: OFF | Turned Off |
| Depressurization Tank Liquid Level Sensor: ON | Turned On |

In addition, as shown in a following [Table 11], when the sub-tank liquid level sensor 102 outputs an "OFF" signal, the controller 5 opens the ink reservoir valve 47 and turns the ink reservoir pump 82 on. On the other hand, when the sub-tank liquid level sensor 102 outputs an "ON" signal, the controller 5 closes the ink reservoir valve 47 and turns the ink reservoir pump 82 off.

TABLE 11

| Condition | Ink Reservoir Valve | Ink Return Pump |
|---|---|---|
| Sub-tank Liquid Level Sensor: OFF | Opened | Turned On |
| Sub-tank Liquid Level Sensor: ON | Closed | Turned Off |

Returning to the description of the operations of the inkjet printer with reference to FIG. 9, the controller 5 starts a pressure control (step S23). The pressure control in the third embodiment is similar to the pressure control in the above-described second embodiment.

Subsequently, the controller 5 determines whether or not the preset pressure Pks and Pfs are generated in the pressurization tank 21 and the depressurization tank 24, respectively (step S24). While it is judged that no preset pressure is generated in the pressurization tank 21 or the depressurization tank 24 (NO in step S24), the controller 5 executes the process of the step S24 repeatedly.

When it is judged that each preset value is generated in the pressurization tank 21 and the depressurization tank 24 (YES in step S24), the controller 5 starts execution of a print job (step S25).

During the execution of the print job, ink is supplied from the pressurization tank 21 to the inkjet head 11, and ink that is not consumed by the inkjet head 11 is collected to the depressurization tank 24. When the pressurization tank liquid level sensor 37 outputs an "OFF" signal due to outflows of ink from the pressurization tank 21 to the inkjet head 11, the ink circulation pump 31 sends ink from the sub-tank 96 to the pressurization tank 21 by the liquid level maintaining control. When the depressurization tank liquid level sensor 40 outputs an "ON" signal due to inflows of ink into the depressurization tank 24 from the inkjet head 11, the ink return pump 98 sends ink from the depressurization tank 24 to the sub-tank 96. In this manner, printing is done while circulating ink.

In addition, when the sub-tank liquid level sensor 102 outputs an "OFF" signal due to supply of ink from the sub-tank 96 to the pressurization tank 21, the ink reservoir valve 47 is opened and the ink reservoir pump 82 is driven. As the result, ink is replenished from the ink cartridge 46 to the sub-tank 96.

After the execution of the print job is started, the controller 5 monitors whether or not the print job is finished (step S26). While it is determined that the print job is not yet finished (NO in step S26), the controller 5 executes the process of the step S26 repeatedly.

When it is determined that the print job is finished (YES in step S26), the controller 5 finished the pressure control (step S27). If the air pump 71 is being driven at this time, the controller 5 stops it. In addition, if any of the pressurization pressure regulation valve 53 and the depressurization pressure regulation valve 58 is still opened, the controller 5 closes an opened valve(s) of them.

Subsequently, the controller 5 finishes the liquid level maintaining control (step S28). If the ink circulation pump 31 is being driven at this time, the controller 5 stops it. In addition, if the ink return pump 98 is being driven, the controller 5 stops it. In addition, if the ink reservoir valve 47 is still opened and the ink reservoir pump 82 is being driven, the controller 5 closes the ink reservoir valve 47 and stops the ink reservoir pump 82.

Subsequently, the controller 5 opens the pressurization and depressurization communicating valve 61 (step S29). Positive pressure of the pressurization system and negative pressure of the depressurization system are offset with each other by opening the pressurization and depressurization communicating valve 61. As the result, pressures in the pressurization tank 21 and the depressurization tank 24 become atmospheric pressure substantially.

Subsequently, the controller 5 opens the diversion valve 100 (step S30). As the result, a series of the operations are finished, and thereby the inkjet printer is changed into the waiting mode.

While the inkjet printer is in the waiting mode, the pressurization tank 21 and the depressurization tank 24 are in the hermetically-sealed state that is hermetically sealed from atmosphere. Since the diversion valve 100 is opened, the depressurization tank 24 is communicated with the sub-tank 96 in the atmospherically-released state via the diversion pipe 99.

Therefore, in the waiting mode, the nozzle pressure Pn of the inkjet head 11 stays at a pressure depending on a level difference (water head difference) H between a liquid level of ink in the sub-tank 96 and the nozzle surfaces 16*a*. Namely, the nozzle pressure Pn in the waiting mode is indicated by the above-described equation (4).

The sub-tank 96 is disposed at a height level such that the nozzle pressure Pn in the waiting mode doesn't exceed a meniscus break pressure, similarly to the collection tank 25 in the first embodiment.

As described above, in the waiting mode in the third embodiment, the controller 5 closes the pressurization pressure regulation valve 53, the depressurization pressure regulation valve 58 and the depressurization atmospheric release valve 86 to make the pressurization tank 21 and the depressurization tank 24 in the hermetically-sealed state, and opens the diversion valve 100 to communicate the depressurization tank 24 and the sub-tank 96 in the atmospherically-released state with each other.

Therefore, the nozzle pressure Pn in the waiting mode is determined according to the height level difference H between a liquid level in the sub-tank(s) 96 and the nozzle surfaces 16*a*. As the result, even if atmospheric pressure changes due to an environment change, the nozzle pressure Pn is restricted from changing, similarly to the first embodiment. Namely, also according to the second embodiment, ink-leaking from the nozzles and air-suctioning through the nozzles in the waiting mode can be restricted.

In the third embodiment, the sub-tank(s) 96 is disposed on the path from the depressurization tank 24 to the pressurization tank 21, and is in the atmospherically-released state in the ink circulating mode and in the waiting mode. In the ink circulating mode, the diversion valve 100 is closed and ink is sent from the depressurization tank 24 to the sub-tank 96 by the ink return pump 98. Compared with the configuration like the first embodiment in which ink is sent from the depressurization tank 24 to the collection tank 25 by use of negative pressure in the depressurization tank 24, decrease of flow volume due to pressure loss in the path from the depressurization tank 24 to the sub-tank 96 can be restricted by using the ink return pump 98. In the waiting mode, the depressurization tank 24 and the sub-tank 96 are communicated with each other via the diversion pipe 99 by opening the diversion valve 100.

Therefore, in a configuration in which the sub-tank 96 is disposed on the ink circulation path, decrease of flow volume in the path from the depressurization tank 24 to the sub-tank 96 can be restricted in the ink circulating mode, and the nozzle pressure Pn in the waiting mode can be determined according to the height level difference H between the liquid level in the sub-tank(s) 96 and the nozzle surfaces 16*a*.

Figure 10:
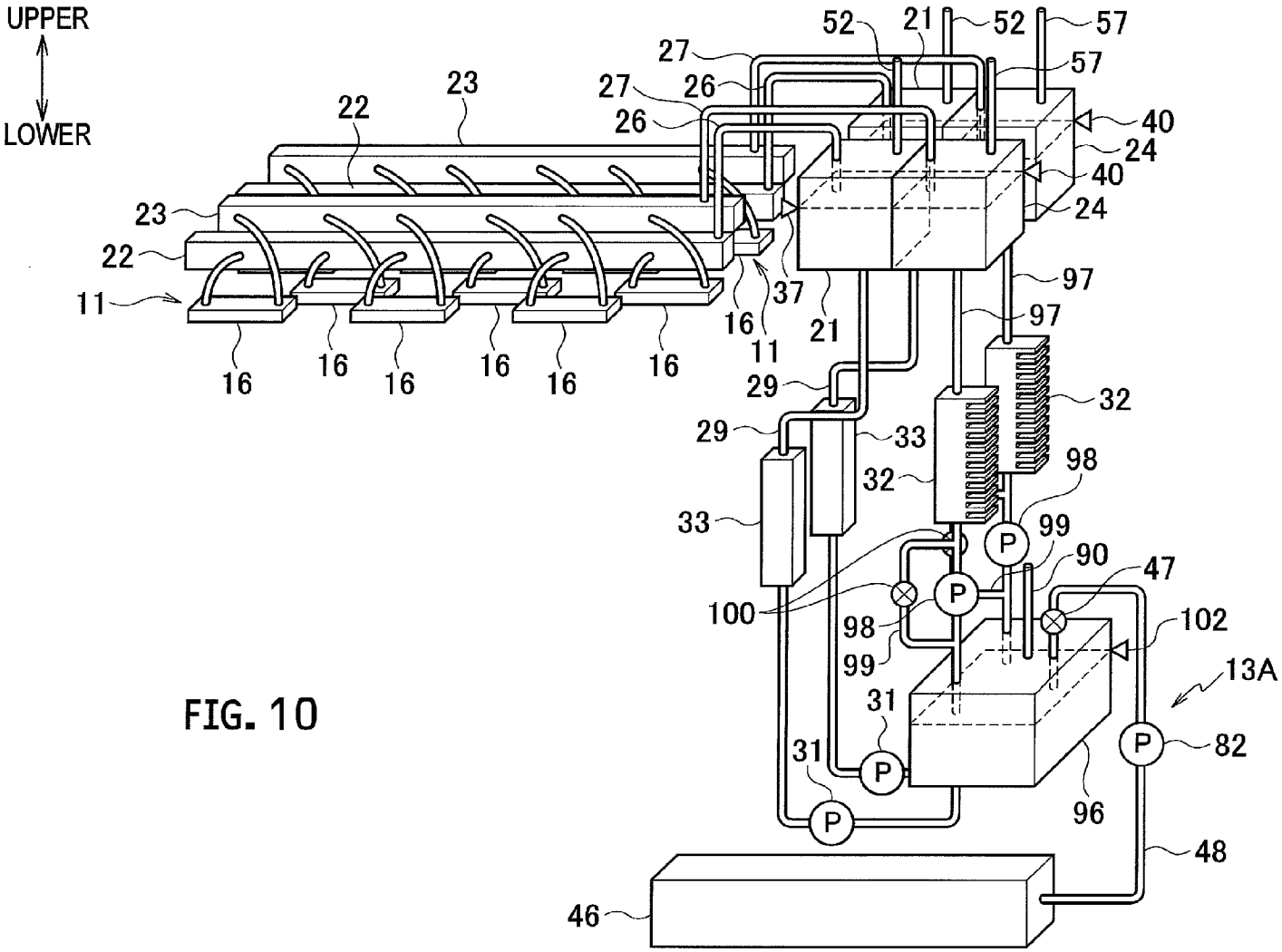
FIG. 10 is a perspective view showing a modified example of the print unit.

Note that, in each of the print units 2B, the inkjet head 11 and every component of the ink circulator 12B other than the sub-tank 96 may be provided in a plurality with respect to the single sub-tank 96. For example, as shown in FIG. 10, the inkjet heads 11, the pressurization tank 21, the distributor 22, the collector 23, the depressurization tank 24, the set of the ink circulation pipes 26, 27, 97 and 29, the ink return pump 98, the diversion pipe 99, the diversion valve 100, the ink circulation pump 31, the heatsink 32 and the heater 33 may be provided in a pair with respect to the single sub-tank 96.

By making the single sub-tank 96 communal for the plural inkjet heads 11, it become possible to establish a configuration provided with the plural inkjet heads 11 for a single ink color without complicating configuration of the inkjet printer.

Note that, also in this case, an air volume of the pressurization system and an air volume of the depressurization system are designed so that positive pressure of the pressurization system and negative pressure of the depressurization system are offset with each other when the pressurization and depressurization communicating valve 61 is opened at the completion of the ink circulation.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

For example, the collection tank 25 is disposed below the nozzle surfaces 16*a* of the inkjet head 11 in the above-described first embodiment. However, the collection tank 25 may be disposed above the nozzle surfaces 16*a* of the inkjet head 11 as long as the nozzle pressure Pn in the waiting mode doesn't exceed a meniscus break pressure. Similarly in the second embodiment, the sub-tank 77 may be disposed above the nozzle surfaces 16*a* of the inkjet head 11 as long as the nozzle pressure Pn in the waiting mode doesn't exceed a meniscus break pressure. Similarly in the third embodiment, the sub-tank 96 may be disposed above the nozzle surfaces 16*a* of the inkjet head 11 as long as the nozzle pressure Pn in the waiting mode doesn't exceed a meniscus break pressure.

The present application claims the benefit of priorities under 35 U.S.C. §119 to Japanese Patent Application No. 2015-104251, filed on May 22, 2015, and Japanese Patent Application No. 2016-56804, filed on Mar. 22, 2016, and the entire contents of them are incorporated herein by reference.

What is claimed is:

1. An inkjet printer comprising:

an inkjet head that has a nozzle surface on which nozzles for ejecting ink are opened;

a first tank that stores ink to be supplied to the inkjet head;

a second tank that receives ink that is not consumed by the inkjet head;

an ink circulation path through which ink is circulated among the inkjet head, the first tank and the second tank;

a third tank that is directly or indirectly connected with a path from the second tank to the first tank on the ink circulation path, and stores ink; and a hermetic sealer that makes the first tank and the second tank in a hermetically-sealed state that is hermetically sealed from atmosphere, wherein the first tank and the second tank are made in the hermetically-sealed state by the hermetic sealer in a waiting mode in which ink is not circulated, and the third tank is made in an atmospherically-released state in the waiting mode.

2. The inkjet printer according to claim 1, further comprising a changer that changes over the third tank between the hermetically-sealed state and the atmospherically-released state, wherein the third tank is disposed on the path from the second tank to the first tank, the third tank is made into the hermetically-sealed state by the changer and negative pressure that is used for sending ink from the second tank to the third tank is generated in the third tank in the waiting mode, and the third tank is made into the atmospherically-released state by the changer in the waiting mode.

3. The inkjet printer according to claim 1, wherein the third tank is indirectly connected with the path from the second tank to the first tank by interposing a connecting path that is connected with the path from the second tank to the first tank.

4. The inkjet printer according to claim 1, wherein, the third tank is disposed on the path from the second tank to the first tank, and made into an atmospherically-released state in an ink circulation mode and the waiting mode, a pump that sends ink from the second tank to the third tank is disposed on a path from the second tank to the third tank, a diversion path that diverts the pump is provided, a diversion switch that is switched over between an opened state for opening the diversion path and a closed state for closing the diversion path is provided, the diversion switch is made into the closed state and ink is sent from the second tank to the third tank by the pump in the ink circulating mode, and the diversion switch is made into the opened state in the waiting mode.

5. The inkjet printer according to claim 1, wherein the third tank is disposed below the nozzle surface.

6. The inkjet printer according to claim 1, wherein the first tank and the second tank is connected with each other while interposing a valve that is opened when being de-energized therebetween, and, when the valve is opened in the ink circulating mode in a state where positive pressure is generated in the first tank and negative pressure is generated in the second tank, the positive pressure in the first tank and the negative pressure in the second tank are offset with each other.

7. The inkjet printer according to claim 1, wherein each of the inkjet head, the first tank, the second tank and the ink circulation path is provided in a plurality with respect to the third tank.

* * * * *